US006676009B1

(12) United States Patent
Rose

(10) Patent No.: US 6,676,009 B1
(45) Date of Patent: Jan. 13, 2004

(54) CONTAINER HAVING A PLURALITY OF SELECTABLE VOLUMES

(76) Inventor: Harold J. Rose, 18 Windham Dr., Concord, NH (US) 03301-5836

( * ) Notice: Subject to any disclaimer, the term of this patent is extended or adjusted under 35 U.S.C. 154(b) by 68 days.

(21) Appl. No.: 09/635,269

(22) Filed: Aug. 9, 2000

Related U.S. Application Data

(63) Continuation-in-part of application No. 09/039,175, filed on Mar. 13, 1998, now Pat. No. 6,119,929, which is a continuation-in-part of application No. 08/940,390, filed on Oct. 1, 1997, now abandoned.

(51) Int. Cl.[7] ..... B65D 5/00; B65D 5/04

(52) U.S. Cl. ..... 229/101; 229/101.1; 229/101.2; 229/237

(58) Field of Search ..... 229/101, 237, 229/101.1, 101.2, 942, 236, 200, 221, 223

(56) References Cited

U.S. PATENT DOCUMENTS

| | | | | |
|---|---|---|---|---|
| 687,643 | A | * 11/1901 | Megloughlin et al. | 229/101.1 |
| 1,125,535 | A | 1/1915 | Hoffman | |
| 1,516,090 | A | 11/1924 | Gary et al. | |
| 1,636,838 | A | 7/1927 | Roser | |
| 1,767,274 | A | 6/1930 | Broderick | |
| 1,808,833 | A | 6/1931 | Brack | |
| 1,846,949 | A | 2/1932 | Clark | |
| 2,056,032 | A | 9/1936 | Berman | |
| 2,133,701 | A | * 10/1938 | Holmes et al. | 229/101 |
| 2,210,302 | A | 8/1940 | Petter | |
| 2,279,381 | A | 4/1942 | Richardson | |
| 2,333,416 | A | * 11/1943 | Ducey | 229/101.2 |
| 2,382,891 | A | 8/1945 | McCormick | |
| 2,454,013 | A | 11/1948 | Scherzinger | |
| 2,936,239 | A | 5/1960 | Rendall | |
| 3,128,031 | A | 4/1964 | Dembo | |
| 3,302,855 | A | 2/1967 | Becker | |
| 3,313,467 | A | 4/1967 | Anderskow et al. | |
| 3,598,303 | A | 2/1969 | Folz | |
| 3,998,378 | A | 12/1976 | Vetten | |
| 4,052,932 | A | 10/1977 | Huiskes | |
| 4,530,459 | A | 7/1985 | Maroszek | |
| 4,592,464 | A | 6/1986 | Londagin | |
| 4,856,709 | A | 8/1989 | Axelsson et al. | |
| 5,016,753 | A | 5/1991 | Henderson | |
| 5,197,659 | A | 3/1993 | Vassiliou | |
| 5,671,883 | A | 9/1997 | Philips | |
| 6,119,929 | A | * 9/2000 | Rose | 229/101 |
| 6,138,901 | A | 10/2000 | Kim et al. | |

FOREIGN PATENT DOCUMENTS

| | | | |
|---|---|---|---|
| DE | 24 37 862 | 2/1975 | 229/101 |
| EP | 0097022 | * 12/1983 | 229/101 |
| JP | 10-157730 | * 6/1998 | B65D/5/54 |
| JP | 10-81329 | * 10/1998 | B65D/5/54 |

OTHER PUBLICATIONS

Corrugated Board Packaging, Gunilla Johnson, Oct., 1993, Pira International.*

* cited by examiner

*Primary Examiner*—Tri M. Mai
(74) *Attorney, Agent, or Firm*—Nixon Peabody LLP

(57) ABSTRACT

A container having a plurality of selectable volumes including a plurality of fold facilitating creases adapted to allow panels to be folded or removed along a fold facilitating crease and/or perforation, further including a first set and a second set of perforations or other separating mechanism extending substantially parallel to a corner edge to thereby define a removable strip for unconnecting panels that form a corner edge from one another. The first set of perforations and the second set of perforations or other separating mechanism are positioned at a spaced distance from each other. The first set of perforations or other separating mechanism is provided on a first panel while the second set of perforations or other separating mechanism is provided on either the corner edge itself or a second panel that form the corner edge. The container may further include lateral perforations as well as flaps, tabs, slits and slots along a top edge of the panels.

47 Claims, 10 Drawing Sheets

CONTAINER HAVING A PLURALITY OF SELECTABLE VOLUMES

BACKGROUND OF THE INVENTION

This application is a Continuation-In-Part of a pending application Ser. No. 09/039,175 filed Mar. 13, 1998, now U.S. Pat. No. 6,119,929 which is a Continuation-In-Part of application Ser. No. 08/940,390 filed Oct. 1, 1997 now abandoned.

FIELD OF THE INVENTION

This invention most generally relates to containers. More particularly the invention relates to containers which may be folded in a manner so as to create a selected volume for the container. Most particularly, the invention relates to mailing or shipping containers made of cardboard, corrugated cardboard, boxboard or the like, which are foldably adjustable with respect to a height dimension and consequent volume in order to accommodate articles or collections of articles having a specific volume. The variable volume container thus eliminates the need for post offices and other mailing and shipping businesses to have to purchase and stock a great variety of sizes of boxes and containers. Storage of variable volume boxes is more efficient, and consumers purchasing boxes for shipping do not have to worry about or guess what size box is appropriate for their packages.

DESCRIPTION OF THE PRIOR ART

Various folding box designs which are foldable from a one-piece blank are known in the art. In this regard, a typical foldable box blank has primary folding lines which may be perforations, indentations, slits, scoring, cuts or any other weakening lines which-provide weakening of the integrity of the unfolded box blank so that the box may be formed by folding at the weakening lines. Such foldable box blanks are usually cut or stamped from a flat sheet of, for example, cardboard. The die used to stamp the blank also scores the blank along selected lines, to enable a person to easily fold the blank along such scores to create the finished container. Some examples of known foldable containers include a typical pizza box, milk carton, and a box used to ship books.

The primary disadvantage with most of the types of boxes discussed above, especially for those in the mailing and shipping fields, is that the box blank can form a box of only one size. Therefore, finished boxes have a fixed and predetermined volume. If a person buys a box, and it is not the right size for the item being shipped, another box must be acquired or the box must be cut down with a sharp instrument such as a knife. Companies that are in the business of packaging goods and mailing and shipping of goods must stock and carry many differently sized boxes or box blanks. In addition, if a box is too big for an item and sufficient packing is not included when the item is packed, there is increased risk of damage to the item or injury to a person carrying the box or container. In particular, the item which is loose in the box may quickly shift if the box is tilted, thus possibly causing damage to the item by hitting the sides of the container, or causing damage to the item or person carrying it when the box is accidentally dropped due to the sudden, unexpected shift of weight. Furthermore, if a force is applied near the top center of a partially filled box, the tape that secures the box can be forced loose.

As a result, various boxes have been designed to be able to form finished boxes having various selectable volumes, thus reducing manufacturing and storage costs, reducing inconvenience for customers attempting to select a container of proper size, and reducing damage to persons and property due to items being placed in inappropriately sized containers. For instance, a book-shipping box known to Applicant comprises a flat rectangular bottom portion with four extending flaps which are each scored along the edge of the bottom portion and at two or three distances out from the flat bottom portion. The scoring enables the flaps to be folded up to different heights to accommodate books of different thicknesses but the corners of the formed boxes remain uncovered. Other examples of boxes having various selectable volumes include U.S. Pat. No. 2,382,891 to McCormick, U.S. Pat. No. 3,302,855 to Becker, U.S. Pat. No. 3,313,467 to Anderskow, and German patent document No. 24 37 862.

In particular, U.S. Pat. No. 2,382,891 to McCormick discloses a box with extending flaps which can be used to close the box. The reference also discloses a plurality of horizontal creases on the side walls of the box and corner creases in the form of a cut-score or perforation is provided at the corners of the box where the side walls are joined. The perforation allows the corner of the side walls to be separated and the side walls to be folded along the horizontal creases to thereby provide a box having various selectable volumes.

Despite the advantages provided by a box having various selectable volumes, actually changing the volumes on such boxes has been found to be very difficult. In particular, the perforations which join the side walls must be separated to adjust the volume of the box. However, in order to do so, the user must grasp the large side panels and tear them apart in opposite directions with respect to one another while at the same time, overcoming the force exerted by the box and the side walls thereof to resist being temporarily deformed which is necessary to separate the side walls. As can be appreciated, such motion is very difficult to control and often results in over tearing the corner perforation thereby weakening the box or rendering it useless. As a result, none of the above noted prior art boxes having various selectable volumes have gained in popularity in the market place despite being known in the art. Therefore, there still exists an unfulfilled need for a container having various selectable volumes where the volume of the container can be easily changed.

SUMMARY OF THE INVENTION

The invention is directed primarily to a container having a plurality of selectable volumes which selectable volumes are made by inwardly folding sides and ends of the container along selectable foldable creases. The invention may also be a container in unassembled form comprised of a flat blank sheet of material foldable to form walls and bottom and scribed or scored before or after assembly into the container, to provide for the selectable creasing and folding. The container may have any suitable use and particularly may be a shipping container or a storage container. Preferably the container, when assembled, is rectangular in cross sectional shape, and may be formed from cardboard, corrugated cardboard, or other suitably strong but creasable and foldable material. The container may be assembleable from a substantially flat form.

In accordance with one embodiment of the present invention, the above objects are obtained by a container having a plurality of selectable volumes including a plurality of fold facilitating creases adapted to allow panels to be folded or removed along a fold facilitating crease and/or perforation, further including a first set and a second set of perforations extending substantially parallel to a corner edge to thereby define a removable strip for unconnecting panels that form a corner edge from one another. In one embodiment, the container may have a rectangular shape while in another embodiment, the container may have a triangular, or other polygonal shape. The first set of perforations and the second set of perforations are positioned at a spaced distance from each other. The first set of perforations is provided on a first panel while the second set of perforations is provided on either the corner edge itself or a second panel that form the corner edge. The container may further include lateral perforations extending laterally between the first set of perforations and the second set of perforations as well as slots along a top edge of the panels.

In accordance with the preferred embodiment of the present invention, the above objects are obtained by a rectangular container having a plurality of selectable volumes including a bottom portion having a substantially rectangular shape with two substantially parallel side edges and two substantially parallel end edges, two side panels attached to and extending upwardly from the two side edges of the bottom portion, and two end panels attached to and extending upwardly from the two end edges of the bottom portion, each of the two side panels having edges which are attached to edges of each of the two end panels to thereby form four corner edges of the container. The container also includes a plurality of fold facilitating creases adapted to allow the two side panels and the two end panels to be folded along at least one of the fold facilitating creases. In another embodiment, the fold facilitating creases may also be formed of fold facilitating perforations instead of, or in addition to, the creases. The container further includes a first set and a second set of perforations extending substantially parallel to a corner edge to thereby define a removable strip for unconnecting a side panel and an end panel that form the corner edge. In this regard, the first set of perforations and the second set of perforations are positioned at a spaced distance from each other, the spaced distance being sufficient to allow a user to grasp the strip to remove at least a part thereof. Further in this regard, slits or slots are provided to allow grasping of the strip in embodiments where end flaps and side flaps used to close the container are provided.

In accordance with the preferred embodiment of the container having a plurality of selectable volumes, the first set of perforations is provided on one of the side panel and the end panel that form a corner edge while the second set of perforations is provided on either the corner edge or the other of the side panel and the end panel that form the corner edge. In one embodiment, the first set of perforations is positioned at a spaced distance between about ⅛ to 2 inches from the corner edge and the second set of perforations is positioned at a spaced distance between about ⅛ to 2 inches from the corner edge. In another embodiment, the second set of perforations is positioned directly on the corner edge itself. In accordance with another preferred embodiment, the first set of perforations and the second set of perforations extend substantially parallel to each of the four corner edges of the container to allow unconnecting of the two side panels and two end panels. Optionally, in these embodiments, slits may be provided to allow grasping of the strip if end flaps and side flaps used to close the container are provided. In addition, the at least one fold facilitating crease of the container may also preferably include an identifiable marking to facilitate identification of the at least one of the fold facilitating creases on the two side panels and the two end panels. Moreover, in accordance with still another embodiment, the fold facilitating creases may also be formed of fold facilitating perforations instead of, or in addition to, the creases.

In accordance with yet another aspect of the present invention, the container having a plurality of selectable volumes in accordance with another embodiment further includes at least one lateral perforation extending laterally between the first set of perforations and the second set of perforations to allow detachment of at least a portion of the removable strip. The lateral perforation is positioned at a height distance larger than the at least one fold facilitating crease so that a tab is provided upon folding of the two side panels and the two end panels along the at least one fold facilitating crease. The tab is adapted to be inwardly folded together with the side panel flaps that are attached along a top edge of each of the two side panels and with the end panel flaps that are attached along a top edge of each of the two end panels, thereby covering the opening of the container.

In accordance with still another aspect of the present invention, to the container having a plurality of selectable volumes in accordance with another embodiment includes a pullable reinforcement instead of the perforations. The pullable reinforcement is embedded and/or attached to the panels, preferably in the interior of the container, and is adapted to be pulled by the user to separate the desired portions of the container without providing perforations as described in the previous embodiments. The edges of the pullable reinforcement generally corresponds to the locations of the perforations of the previous embodiments and thus, serve a similar function as the perforations in that the panels are separated at or along the edges of the pullable reinforcement. The pullable reinforcement may also include a reinforcement filament embedded therein to provide further strength to the pullable reinforcement.

The invention has the particular objectives, features and advantages of: 1) being less costly to a reseller because fewer sizes of basic container need to be retained in stock in order to accommodate many sub-sizes; 2) adjustable volume allowing container to hold items more snugly, with less internal movement, thus in some cases eliminating or at least reducing the need for additional packing material, thereby reducing shipping/packaging cost; 3) a variable volume container is advantageous for a catalog merchant who ships varied items and/or quantities in a single box; 4) the container is more environmentally friendly, by reducing the need for extra packing material; 5) less time would be spent in a shipping department figuring out what size container to use for a variety of products; 6) adjustable size is likely cheaper to ship because the appropriate smaller sizes could be selected, thus reducing space for shipping, reducing the number of parcel containers, airplanes, and trailers needed for shipping and consequently reducing the total number of miles driven, gas used, maintenance and repair costs and labor costs; 7) having filled containers ready for shipping which take up less warehouse space, thereby reducing cost; 8) saving on storage space for packing material; 9) all versions of the invention increase safety by eliminating the need to use any type of sharp blade to reduce the volume of a box; 10) cutting down the corners of a container by hand with a sharp blade in order to reduce its volume usually produces cuts of different length and/or cuts that are not straight, resulting in a container, once it is sealed, that is uneven/asymmetrical and therefore not only unpleasing to the eye, but also difficult and unsafe to stack; 11) an embodiment of the invention with precut sealing strips increases efficiency and saves time at the Post Office, because postal clerks would no longer have to tape boxes for customers, thereby saving the Post Office labor time and cost of materials for taping, and saving time for all customers, especially those waiting in line; 12) savings in damage and replacement cost for items damaged in shipping due to internal movement of the item within a container too large for the item; 13) being available in several base adjustable sizes, and being available in heavy and light weight versions, for various goods; 14) being more cost effective for consumers who wouldn't have to buy, along with a box, a package of packing material, and a full roll of tape or other sealing material—an appropriately sized container with just the right amount of sealing material would be available as a kit; 15) providing a more robust container which can be more effectively packaged, sealed and stacked; 16) providing a cost effective and economically viable container having variable volumes; 17) providing cost and volume savings since only one model of box need be manufactured and/or purchased; and 18) providing a container which may be reused at a same volume configuration or a smaller volume configuration.

These and further objects of the present invention will become apparent to those skilled in the art to which this invention pertains after a study of the present disclosure of the invention.

DESCRIPTION OF THE PREFERRED EMBODIMENTS

Figure 1:
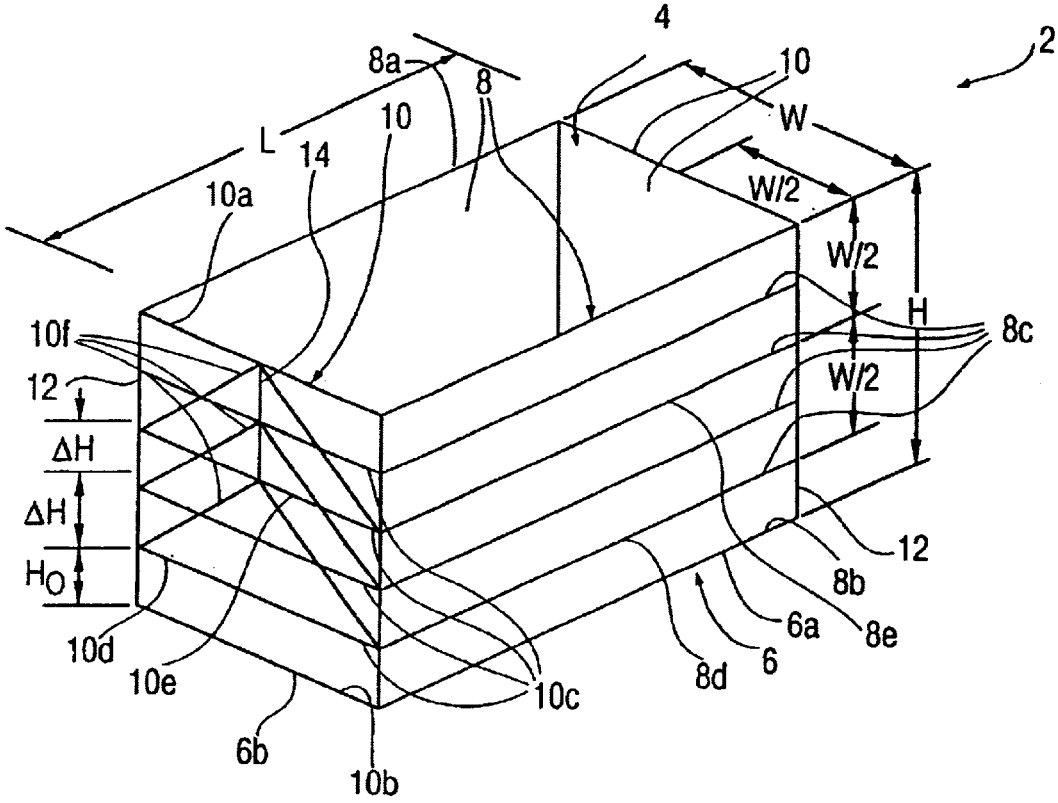
FIG. 1 is a perspective view of the container of one embodiment of the variable volume container of the present invention, showing the container in an unfolded position, with a set of cooperating fold facilitating creases formed in the container.

The following is a description of the preferred embodiments of the invention. It is clear that there may be variations in the size and the shape of the variable volume container, and in the materials used in the construction. The particular embodiments to be described in detail herein will have three selectable volumes; that is the numeral "n" which is used to identify the number of selectable volumes has the particular value of three (3). Clearly, the number of possible volumes is in part governed by materials and both a minimum and a maximum size of the containers. The value of "3" for "n" is not to be deemed as limiting; it is merely the example used in this description. Also discussed and shown in the drawing figures is the particular case where the incremental height delta H ($\Delta H$) is substantially the same value. That is to say, that the changes in volume are incremental in that the volume height dimension increases by $\Delta H$ for each incremental volume increase. Clearly the change in height need not be in equal increments; however, most likely the container would be made in this manner. While the preferred material for the container would be cardboard or corrugated cardboard and the like, plastics or similar products which are creasable and foldable could be used.

Reference is now made to the drawings in which similar embodiments are enumerated with like numerals in referring to like elements to thereby clarify the embodiments disclosed in the present application. There are discussed basically two embodiments of the invention, container 2 sometimes referred to herein as foldable container 2, which has pairs of triangularly shaped creases, called herein hypotenuse creases 10*f* on end panels 10 schematically illustrated in FIGS. 1, 2 and 3 and there are containers, sometimes referred to herein as tearable containers, illustrated in FIGS. 4 to 16B, each shown as having various selectable volumes. As shown, the embodiment of FIGS. 4 and 5 have tearable perforations 32 coincident with corners 30 where side panels 26 and end panels 28 join for container 20, and for container 40 pairs of perforations 32 each perforation 32 of the pairs of perforations being substantially parallel and spaced from corner 30 one perforation 32 of the pair being on sides 26 and the other on ends 28.

FIG. 1 shows container having a plurality of selectable volumes 2 (foldable container) with a plurality of pairs of hypotenuse creases 10*f* (in this instance three (3) pairs i.e., n=3). There is a perpendicular crease 14 on each end panel 10. Perpendicular creases 14 begin at a point located at the mid-point of the width dimension W (i.e., at ½ W) on top edges 10*a* of each end panel 10. Perpendicular creases 14 extend to the point where the lower-most pair of hypotenuse creases meet. Perpendicular creases 14 substantially bisect the 90 degree angle formed by the junction of each pair of hypotenuse creases 10*f*. There are four (4, i.e., n+1) sets of fold facilitating creases 8*c* on each of side panels 8. Each crease of each of the n+1 sets of creases is substantially parallel to side panel bottom edge 8*b*. There are four (4, i.e., n+1) sets of fold facilitating creases 10*c* on each of end panels 10. Each crease of each of the n+1 sets of creases is substantially parallel to end panel bottom edge 10*b*. Each hypotenuse crease of a pair of E,?hypotenuse creases meets the cooperating creases 8*c* and 10*c* at one of the four corners 12 where side panel 8 meets end panel 10. The angle formed between a crease 10*c* and the intersecting hypotenuse crease is substantially about 45 degrees. I.e., the length of each hypotenuse crease is about 1.414 times one-half width dimension W. Alternately hypotenuse crease length is about 0.707 times width dimension W. Fixed dimension bottom portion 6 has parallel opposing bottom portion side edges 6*a* and parallel opposing bottom portion end edges 6*b*. Bottom portion 6 may be pre-assembled but may be assembleable from a substantially flat form. Bottom portion 6 is connected to two opposing parallel side panels 8 and two opposing parallel end panels 10 along side panel bottom edges 8*b* which have length L, and end panel bottom edges 10*b* which have width W, such that side panels 8, end panels 10 and bottom portion 6 join to form container 2 having corners 12 where side panels 8 meet end panels 10.

Open top 4 of container 2 is defined by side panel top edges 8*a* of two side panels 8 and end panel top edges 10*a* of two end panels 10. Folding of the material of each side panel 8 and each end panel 10, in a manner cooperating with the other side panel 8 and end panel 10, closes container 2 and thereby encloses a preselected volume $V_k$. Once formed to the desired volume, container 2 is sealed with a sealing material, preferably tape. Container 2, and bottom portion 6 have a fixed length dimension L, and a fixed width dimension W. Container 2 has a height dimension H determined by height dimension H of the side and end panels. For the minimum volume of container 2, side panel lower-most crease 8d and end panel lower-most crease 10*d* are used. Creases 8*d* and 10*d* are located a minimum volume height distance $H_0$ from bottom edges 8*b*and 10*b* respectively. For subsequently larger volumes, volume height $H_0+k\Delta H$, where k is either 1 or 2 in the instance shown in FIG. 1, determines the volume of the container; that volume height being the sum of the minimum height $H_0$ (the distance from the bottom edges 8*b* and 10*b* to the lower-most set of creases) and $k\Delta H$. Where incremental height $\Delta H$ is substantially equal between cooperating sets of creases, $\Delta H$ can be computed by taking the overall height H, subtracting $H_0$, then subtracting the quantity of one-half of the width dimension W, and dividing the result by the number of $\Delta H$'s going from the lower-most creases 8*d* and 10*d* to the upper-most or top-most volume determining fold facilitating creases 8*e* and 10*e*. In FIG. 1 there are two $\Delta H$'s i.e., for n=3 that meaning three volumes, the number of $\Delta H$'s is n−1 or in this instance two (2). In order to have complete closure of open top 4 for maximum volume $V_{n-1}$ here $V_2$, top-most volume determining fold facilitating creases 8*e* and 10*e* must be located about one-half container width W (½ W) from top edges 8*a* and 10*a*.

A closure flap 16 may be added to one of side panels 8 to facilitate more fully or more completely sealing the container.

Figure 2:
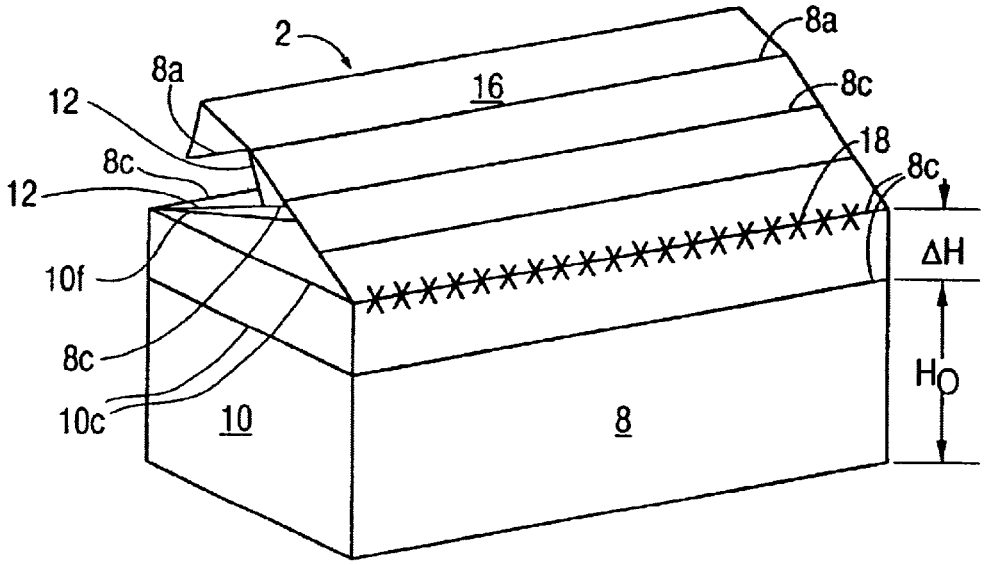
FIG. 2 is a perspective view of the embodiment shown in FIG. 1, showing a container of a particular kth volume, k=1 in this instance, partially formed wherein a particular set of cooperating fold facilitating creases is used to form a container of a particular volume. An optional closure flap is also shown.
Figure 3:
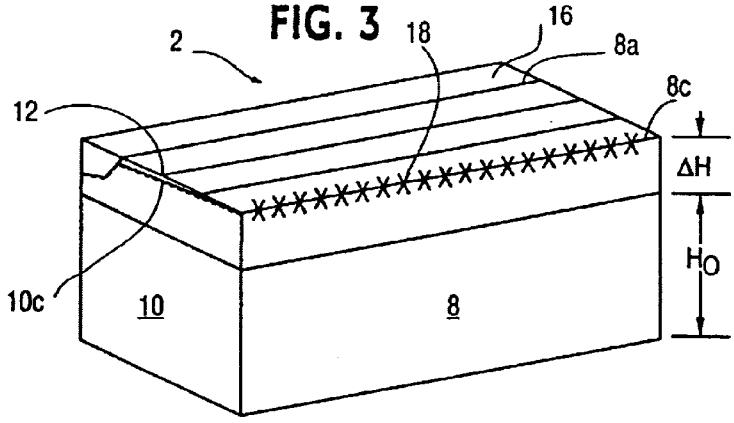
FIG. 3 is a perspective view of the embodiment of FIGS. 1 and 2 wherein a container of a particular kth volume, k=1 in this instance, has been formed and closed.

For example, in a container 2 with 3 possible volumes, such as that shown in FIGS. 1, 2, and 3, n is the numeral 3, thus k as the subscript for a selected volume $V_k$ is chosen from the values 0, 1, and 2 (i.e., 0 to n−1) for designating the three possible volumes, $V_0$, $V_1$, $V_2$. For each selection of k for a particular volume $V_k$, a kth cooperating set of side and end panel creases 8*c* and 10*c* respectively is selected or specified. While there are four (4) sets of these creases 8*c* and 10*c* there are only three (3) sets of these creases which determine volume. The fourth (4th, i.e., n+1) is required to allow folding of the panels for medium volume $V_{n-1}$. In the container 2 there are a total of n+1 of sets of cooperating side and end panel creases, or 4 total side and end panel creases for the instance of n=3 selectable volumes. For each selection of k for a particular volume $V_k$ a kth cooperating set of side and end panel creases is selected or specified. Again, while there are four (4) sets of these creases 8*c* and 10*c* there are only three (3) sets of these creases which determine volume. For designating the number of pairs of hypotenuse creases 10*f*, k is chosen from the values 0, 1, and 2, which yields n number of pairs of hypotenuse creases 10*f*, in this case, 3 pairs of hypotenuse creases.

In general, however, container 2 has a particular volume $V_k$ wherein, for a specific numeral for k, the volume $V_k$ is a selectable volume selected from a plurality of selectable volumes. The total number of possible volumes is equal to n and finite, but preferably the number of volumes n is between about two and six for a given container. The container has a maximum and a minimum volume. For k=n−1, $V_{n-}1$ is a maximum volume and for k=0, $V_0$ is a minimum volume. The k=0 side and end panel creases will be the lower-most creases 8*d* and 10*d* respectively. The k=n−1 will designate the upper-most or top-most creases 8*e* and 10*e* which creases define the maximum volume. The (n+1)th set of creases are needed for closure of the top of the container when the volume $V_{n-2}$ is being formed. For foldable container 2 there are n+1 substantially parallel side and end panel creases. The kth panel-distance or what may be referred to as volume height is substantially about a minimum height dimension $H_0$ plus k times a delta H ($\Delta H$) where the $\Delta H$ is a predetermined, (but each $\Delta H$ need not necessarily be equal to each other ΔH) fractional amount of the total height dimension H. The delta H is the spacing between consecutive side panel creases, and is preferably constant, making the spacing between side panel creases equal, however the spacing need not be equal. ΔH is preferably about equal to the height H minus the minimum height $H_0$ minus the distance of one-half W, the result divided by the integer n−1. For designating particular volumes the numeral k is selected from the numerals 0, 1, 2, 3, . . . , n−1. The numerical value of n, i.e., the number of possible volumes is a function of the container dimensions of length L, width W and height H and of the material composition of the container.

For k equal to n−1, which yields the maximum volume, the (n−1)th paneldistance is not greater than the height dimension H minus one-half W. If this was not the case, the top edges of the side panels would not meet when folded and the container could not be completely closed. The minimum height (i.e., for k=0) would be defined such that the top edges of the side panels, when joined by folding, would not extend beyond the opposing side of the container. However, it is possible, if a lesser minimum height was needed or desired, additional suitably placed fold facilitating creases could be positioned on the side and end panels so that the extending side panel top edges (which close the container and just meet when the container is used in the maximum volume position) could be folded over and down along the opposing side of the container. Additionally, although the example illustrated shows a container formed wherein the opposing top edges of the side panels which close the container meet each other, it is possible to "overstuff" the container, such that the side panels do not meet to fully close the container. The gap created thereby could be covered-over with suitable packaging material.

When a user of container 2 causes folding along the kth creases, all of the cooperating kth creases and the perpendicular creases result in the container closing at the open top, thereby enclosing within the container a selected volume $V_k$. The volume $V_k$ would equal the product of the length L, the width W, and the kth panel-distance, i.e., the volume height, $H_0+k\Delta H$.

FIG. 2 shows a partially folded container 2 in which a particular kth cooperating set of fold facilitating creases is chosen to form a desired volume $V_k$ for container 2 . In order to form the folded container 2, a user selects the desired fold facilitating creases. Each set of cooperating fold facilitating creases may be marked with some sort of different identifiable marking such as color, or symbols, for example the X's shown as element 18. In this example, as seen in FIG. 2, container 2 is being folded to create the second volume $V_1$ (the first volume or the minimum volume being $V_0$). The side and end panels are folded at the second set of creases and the end panels folded at the second pair of hypotenuse creases.

To fold the container, one hand is preferably placed inside container 2, along one end panel 10 of the container, and just below the second fold facilitating crease. The other hand is placed along the outside of the same end panel 10 of container 2. The outside hand then presses inwardly and downwardly at the 90 degree angle of the second set of hypotenuse creases while the inside hand supports and guides the folding. Once the first end panel 10 has begun to fold, the other end panel 10 is folded in the same manner, resulting in a partially folded container. Either side panel, if there is no closure flap, for example one side panel 8, is then folded inwardly toward the other side panel 8, which is folded inwardly and downwardly toward the first-folded side panel 8 and also folded back on itself at the fold facilitating crease positioned ½ W above the second fold facilitating crease, to lay partially underneath the first folded side panel 8, as shown in FIG. 2. Attached to side panel 8 is shown optional closure flap 16.

FIG. 3 shows container 2 in a final folded form, using optional closure flap 16 to secure container 2 in its folded form. It is important to note that when container 2 has been creased and folded to create a particular chosen volume, the container is substantially as strong and stable in volume as a box/container which does not incorporate the volume selectable features of the present container 2. In fact, when container 2 is used for less than the maximum volume, the container is stronger than conventional containers because of the overlapping at the top.

Figure 4:
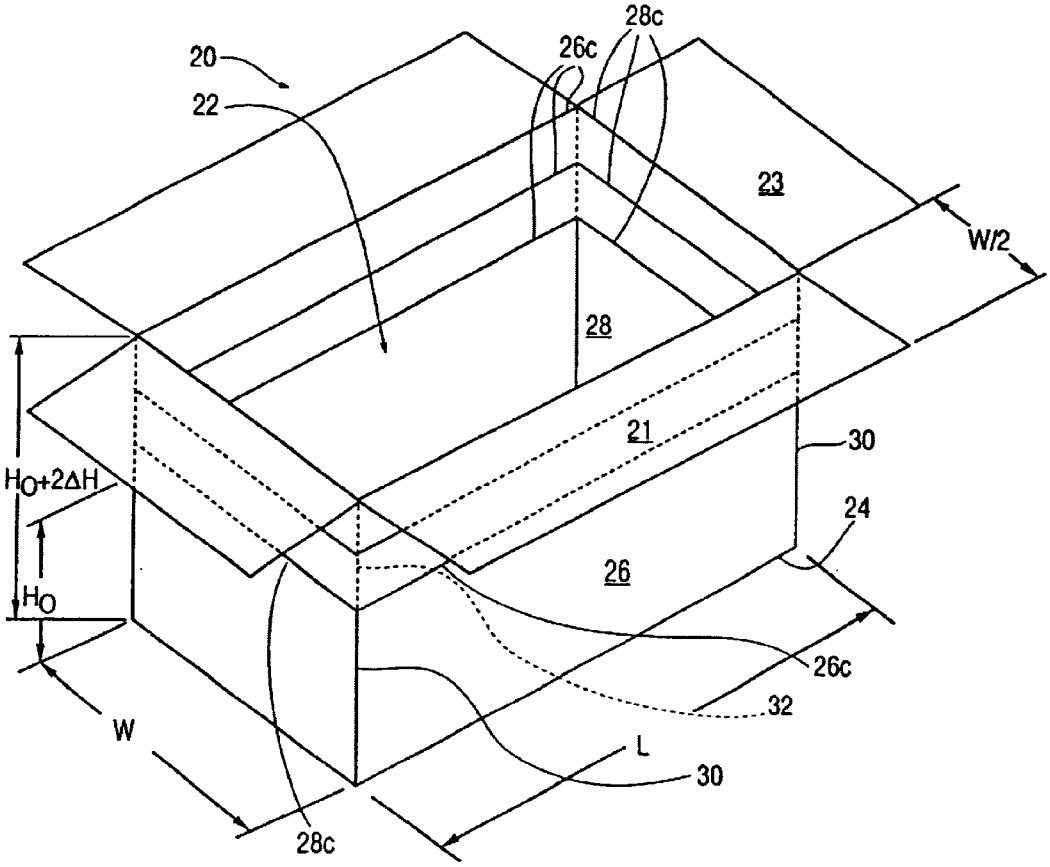
FIG. 4 shows a partially cut away perspective view of another embodiment of variable volume container having tearable perforations at each corner such that the corners may be torn downward at the perforations to a selected set of fold facilitating creases which when folded inwardly on the selected set of fold facilitating creases results in the desired volume container.
Figure 5:
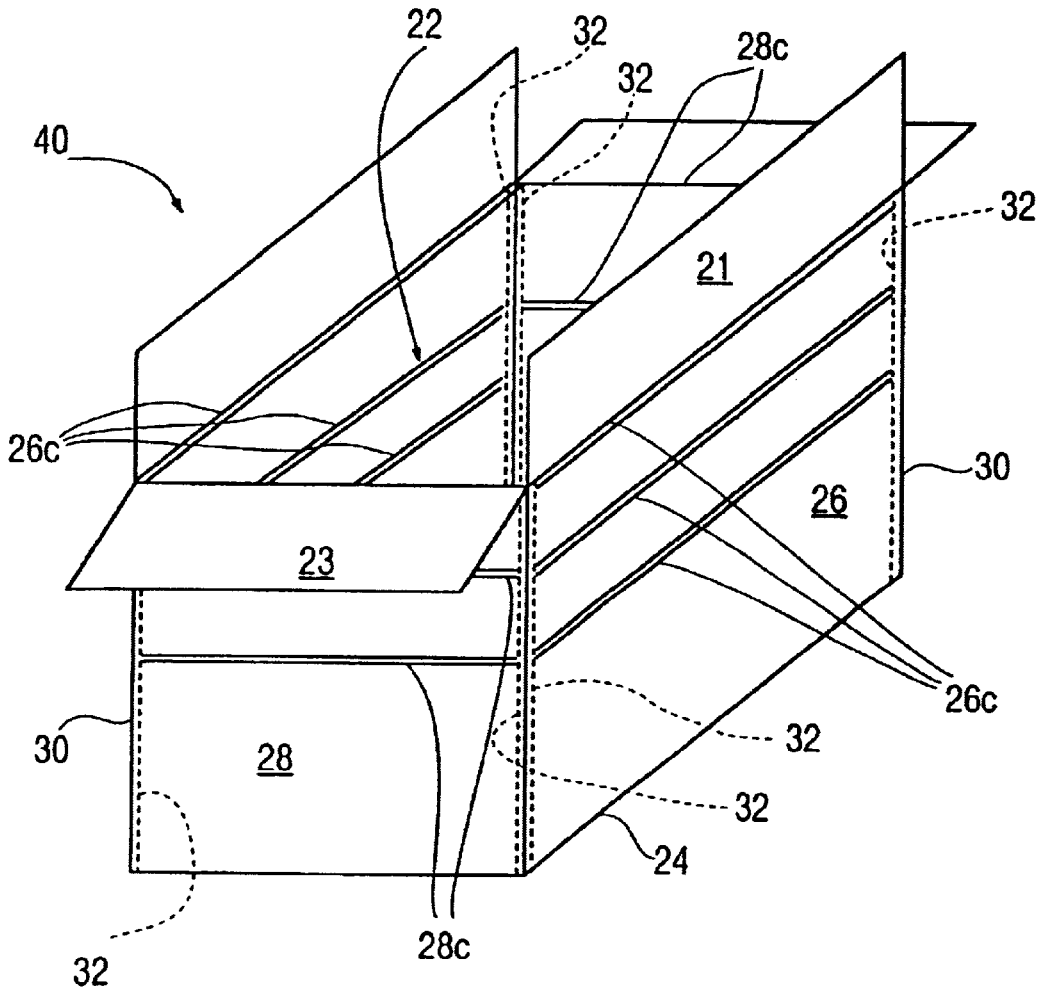
FIG. 5 shows a partially cut away perspective view of yet another embodiment of variable volume container having pairs of tearable perforations at each corner such that the corners may be torn downward at each of the pairs of perforations to a selected set of fold facilitating creases which when folded on the selected set of creases results in the desired volume container.

Another embodiment of the present invention is shown in FIGS. 4 and 5. Containers 20 and 40 each are shown having four (4) closure flaps, two (2) side panel flaps 21 and two (2) end panel flaps 23. The height dimension of the flaps, that is the distance from the top-most set of creases 26*c* and 28*c* to the top edge of the flaps is preferably not greater than ½ the width dimension W of either container 20 or container 40. This dimension limitation simply provides total closure of open top portion 22 when the maximum volume of the container is used. The maximum volume being obtained when the top-most creases are used for closing the flaps. There are generally a plurality (n) of sets of fold facilitating creases 26*c* and 28*c* on the side panels 26 and end panels 28. In each of FIG. 4 and FIG. 5, there is illustrated the particular number of sets being three (3). If the numeral n is used to represent the number of selectable volumes for container 20 or container 40, then in the FIGS. 4 and 5 illustrated container 20 and container 40 respectively, n would equal 3 (n=3). Thus there would be three (3) selectable volumes, each of the three being denoted by $V_k$, k being an integer chosen from 0, 1, . . . n−1. Thus the minimum volume is $V_k$=0 or $V_0$. The maximum volume is $V_k$=(n−1) or $V_{n-1}$. Thus for the case of n=3 the three selectable volumes are $V_0$, $V_1$ and $V_2$. Each of the selectable volumes would have a volume computed by the product of W times L times the sum of ($H_0+k\Delta H$). The sum ($H_0+k\Delta H$) may be considered as the volume height. Minimum height $H_0$ yields the minimum volume $V_0$. Incremental height ΔH is substantially the distance between sets of creases. Selection of the kth volume necessarily specifies the kth set of fold facilitating creases. Preferably for $V_0$ , the 0th or the lower-most set of creases will be positioned down from opening 22 (e.g., down from the top edges of the flaps shown in FIGS. 4 and 5) by a distance of about container width W. Thus when flaps are created or increased in size by tearing down the perforations 32, which perforations 32 are located coincident with corners 30 for container 20 and which pairs of perforations 32 are spaced between about ⅛ inch to about ⅜ inch from corners 30 and parallel thereto for container 40, to the lower-most set of creases, the height of the flaps will be not more than container width W. However, even if the flap height is greater than W, that is the minimum volume is less, the excess flap material of the side flaps may be either cut off (or torn off if horizontally perforated) or if creases are provided the excess could easily be folded back over itself or under itself or folded over the opposite side and secured appropriately. Of course the underneath flap would have to be cut off (or tom off if horizontally perforated) or otherwise folded back over itself or under itself or tucked in.

Clearly, there may be theoretically any number of volumes but the number of volumes, i.e., the value of n will be a reasonable finite number such as an integer greater than one (1) but less than perhaps seven (7). Perforations 32, i.e., a means for permitting the tearing from at least between the top-most crease and the lower-most crease, is provided at the four corners 30 where side and end panels join for container 20 and is also provided on container 40, as pairs of perforations 32 each perforation 32 of the pairs of perforations being substantially parallel and spaced from corner 30 one perforation 32 of the pair being on sides 26 and the other on ends 28. It is also within the scope of the invention to have perforations which extend from bottom portion 24 which has a length of L and a width of W to open top 22 (with flaps omitted) of container 20 or container 40. Flaps would then be created by tearing down perforations 32 from open top 22 to the set of creases selected based upon the selected volume. The top-most set of creases would be a distance from open top 22 not less than ½ of W so as to permit complete closure of open top 22. However, in the event the distance from the top-most crease to the open top 22 is less than ½ W, a cover panel of sorts could be placed over open top 22 to cover the gap thereby created. H—the container height is the distance from the container bottom to the top edge of the created flap.

The method for making container 2 and for forming a selected volume for container 2 comprises the steps of taking an unassembled (or an assembled) corrugated cardboard box (other foldable and creasable material may be used) and while in the flat unassembled form, sets of cooperating fold facilitating creases could be put onto the side and the end panels, these creases being substantially parallel to the bottom edges of the panels. Additionally, the hypotenuse creases and the perpendicular crease on each end panel could be "scribed" onto the end panels all done before the container is assembled or formed. When the container is to be used it would be assembled from the flat form. The particular volume desired is determined and the appropriate set of cooperating creases is used to create the desired volume. The different possible volumes would be determined by the change in the height dimension H given that the container will have a specific length L and width W. The desired volume is selected and the set of cooperating creases, the substantially parallel creases on the side panels and the end panels, and the cooperating hypotenuse creases i.e., the cooperating hypotenuse crease pair on each end panel and the perpendicular crease on each end panel, are appropriately folded resulting in a closed container having the selected volume.

For the embodiment of container 20, having means for facilitating tearing (such as perforations) along the four container corners 30 from the open top 22 to the selected kth crease, the method comprises perforating at the four corners, tearing to the kth crease and causing folding along the kth creases thereby cooperatively closing the open top and enclosing within container 20 a volume $V_k$. The volume $V_k$ would equal length L times width W times the kth panel-distance (the variable height H distance).

For the embodiment of container 40, having means for facilitating tearing (such as perforations) along the four container corners 30 from the open top 22 to the selected kth crease, the method comprises perforating at the four corners with pairs of perforations 32 between about ⅛ inch and about ⅜ inch from each of corners 30 and paralleling corners 30, tearing to the kth crease and causing folding along the kth creases thereby cooperatively closing the open top and enclosing within container 40 a volume $V_k$. The volume $V_k$ would equal length L times width W times the kth panel-distance (the variable height H distance).

With either method of creating a container of selected volume, there could also be a closure flap attached to the top edge of one of the two side panels in either the embodiment of container 2 or container 20 or container 40. There would then be an additional method step after the container is closed wherein the closure flap would be secured to permit or assure an overlap when the container has the maximum volume $V_{n-1}$. It is also possible to use the closure flap to cover a gap left if the container were formed at the nth fold facilitating creases such that none of the panels would meet.

Although not shown, the present invention could also be embodied in a kit for forming a container of selectable variable volume comprising an unmarked container blank, means for marking the container blank, instructions for marking the container blank such that a container of discrete variable volume is made by folding the container blank according to markings or fold facilitating creases made following the instructions, and possibly lengths of precut tape to secure the folded container in a particular discrete volume. The means for marking which might be included in the kit could be a knife edge such as a knife or razor blade, wherein markings would be cut into the container blank, or simply a hard straight edge wherein markings or creases would be pressed into the container blank. The kit could also include a template and/or stencil for drawing or otherwise marking fold facilitating creases and possibly the template would have hard, straight edges of appropriate, differing lengths. The container blank would be cut or creased according to the instructions, thereby forming lines, scorings, cuts, or creases such that the container blank would be foldable along the cut or creased lines, into a container of a particular volume. Thus such a kit may include, along with the container blank, tape or tape and templates or templates alone. Any combination of elements could be considered as a kit.

The marking may comprise cutting into the container blank according to the instructions, thereby forming cut or score lines such that the container blank may be folded along the cut or score lines, into a container of a particular volume. The marking may also comprise pressing creases into the container blank according to the instructions, thereby forming crease, or fold lines, wherein the material of the container is not actually cut or pierced, such that the container blank may be folded along the crease or fold lines into a container of particular volume. Additionally the marking may comprise tearably perforating the container blank according to the instructions such that the container blank may be torn to an appropriate height and then folded into a container of a particular volume.

Also not shown are variations of both creased container 2 and perforated container 20. It is possible to have a container with a combination of both creases and perforations. It is also within the scope of the invention to provide for cooperating sets of creases and/or perforations extending downwards from the top portion as previously described, but also extending upwards from the bottom portion to give even more flexibility in selecting a volume size. For example, there could be a container similar to container 2 wherein the bottom would not be already sealed, and wherein the container would have creases towards the top portion like container 2, and perforations towards the bottom portion, such that the bottom could be torn to the desired distance, then sealed and then the top folded, thus adding to the number of possible volumes provided by the container. There could of course be containers combining two groups of creases, top and bottom, or two groups of perforations, top and bottom.

In another embodiment there could be included possibly, but not necessarily, pre-attached padding as an additional element of the present invention, wherein padding is attached to the container. Also possible is molded foam padding, preferably with inter-meshing raised and lowered portions. The inter-meshing portions are desirable so that when shipped empty in quantity and stored, the unassembled containers would take up as little space as possible, yet when assembled would provide protection for the items shipped. In this way also, time and expense would be saved by a customer trying to safely pack and ship a delicate item. The appropriate padding would be included with the container. Padding could be pre-attached or simply included loose as part of a kit.

Figure 6:
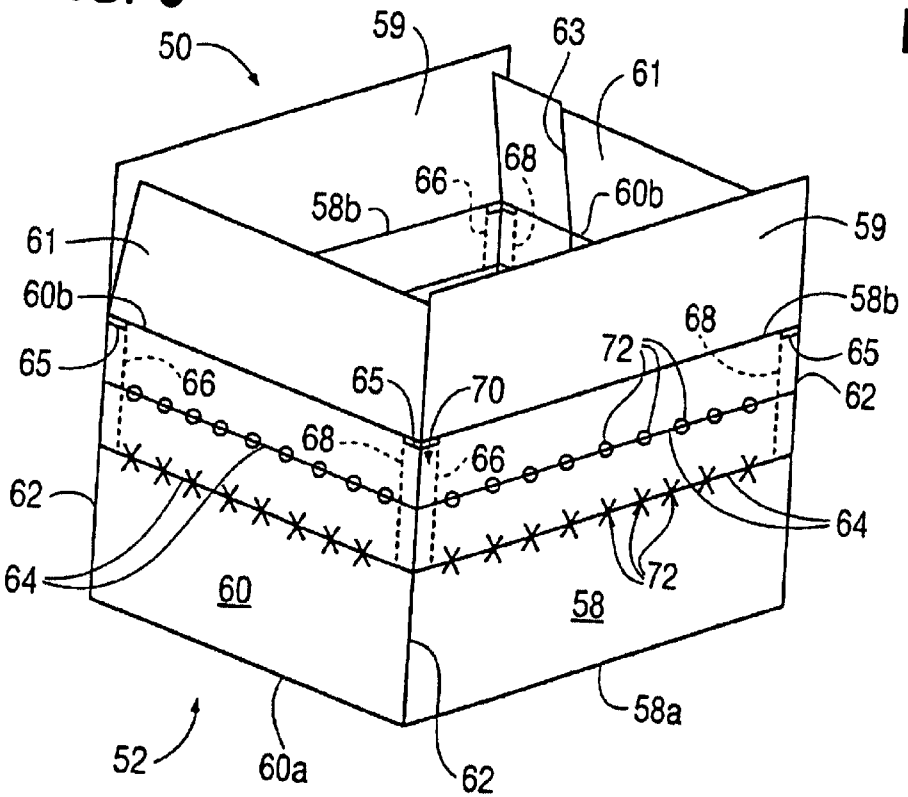
FIG. 6 shows a perspective view of still another embodiment of the variable volume container in accordance with the present invention.

FIG. 6 shows still another embodiment of a container 50 having various selectable volumes in accordance with the present invention where the volume of the container 50 can be easily changed. As generally known in the art of containers, the container 50 includes a bottom portion 52 having a substantially rectangular shape with two substantially parallel side edges 58*a* (only one shown) and two substantially parallel end edges 60*a* (only one shown). Two side panels 58 (only one shown) are attached to and extend upwardly from the two side edges 58*a* of the bottom portion 52, and two end panels 60 are attached to and extend upwardly from the two end edges 60*a* of the bottom portion 52. As can be readily appreciated, each of the two side panels 58 have edges which are attached to edges of each of the two end panels 60 to thereby form four corner edges 62 of the container 50. In addition, in the illustrated embodiment, the container 50 also includes side panel flaps 59 that are attached along a top edge 58*b* of each of the two side panels 58 and end panel flaps 61 that are attached along a top edge 60*b* of each of the two end panels 60. As known in the art, the side panel flaps 59 and the end panel flaps 61 may be used to cover the opening of the container 50 formed by the two side panels 58 and the two end panels 60. In the illustrated configuration, the variable volume container 50 would have its maximum volume. In addition, because the containers of the type described herein are frequently manufactured from a flat container blank (not shown), the two side panels 58 and the two end panels 60 are often made from a single panel which is folded into a rectangular shape and glued or otherwise affixed along a vertical overlapping seam 63.

In the manner previously described, the container 50 also includes a plurality of fold facilitating creases 64 adapted to allow the two side panels 58 and the two end panels 60 to be folded along at least one fold facilitating crease to thereby provide a container having various selectable volumes. Of course, it should be appreciated that whereas in the illustrated embodiment of FIG. 6, only two fold facilitating creases are shown, other embodiments of the present invention may be provided with a different number of fold facilitating creases. As clearly shown in FIG. 6, one of the fold facilitating creases 64 is positioned at a greater height distance from the bottom portion 52 than the other fold facilitating crease 64. In addition, as can be appreciated, each of the fold facilitating creases 64 extends along each of the two side panels 58 and the two end panels 60 in a substantially continuous manner. Moreover, whereas in the present illustrated embodiment of FIG. 6, the plurality of fold facilitating creases 64 are merely folds, in other embodiments, the fold facilitating creases may also be formed of fold facilitating perforations instead of, or in addition to, the folds. Thus, the term "fold facilitating creases" should be understood more broadly to mean creases, perforations or a combination thereof.

The container 50 further includes a first set of perforations 66 and a second set of perforations 68 that extend substantially parallel to a corner edge 62 to thereby define a removable strip 70 for unconnecting the side panel 58 from the end panel 60 that together form the corner edge 62 when connected. In this regard, the first set of perforations 66 and the second set of perforations 68 are positioned at a spaced distance from each other on the container 50. Preferably, the spaced distance is sufficient to allow a user to grasp the removable strip 70 to remove at least a part thereof. As can be appreciated, by grasping the removable strip 70 and removing at least a portion of it along the perforations in a direction towards the bottom portion 52, the illustrated side panel 58 and the end panel 60 are unconnected/separated along the removable strip 70. These perforations allow the side panel 58 and the end panel 60 to be folded along a fold facilitating crease 64 to provide a container 50 having the desired volume which in the illustrated embodiment, would be an intermediate volume and a minimum volume in the manner discussed further herein below.

In this regard, to facilitate the grasping and removal of the removable strip 70, the present illustrated embodiment is also provided with optional slits 65 which extend between the corner edge 62 and the first set of perforations 66 and the second set of perforations 68. As can be appreciated, these slits 65 allow the user to more easily grasp and remove the removable strip 70 when the container 50 is provided with side panel flaps 59 and the end panel flaps 61 in the manner shown. Of course, the slits 65 can also be slots in which the openings formed thereby are slightly larger than those of the slits 65. In this regard, the term "slits" should be construed to mean either a slit or a slot which generally serve a similar function of allowing the user to more easily grasp and remove the removable strip 70. Furthermore, in alternative embodiments of the present invention, the removable strip 70 may be reinforced with a continuous or discontinuous reinforcement backing (not shown) which is provided on the back of the removable strips 70 so as to ensure facilitated removal of the removable strip 70.

As can also be seen in FIG. 6, in accordance with the preferred embodiment of the container 50, the first set of perforations 66 is provided on the side panel 58 while the second set of perforations 68 is provided on the end panel 60 that together with the side panel 58, form the corner edge 62. Thus, the first set of perforations 66 and the second set of perforations 68 are positioned to straddle the corner edge 62 in the manner shown and are positioned at a spaced distance between about ⅛ to 2 inches from the corner edge 62. Preferably, the first set of perforations 66 and the second set of perforations 68 are positioned at a spaced distance between about ⅞ to 2 inches from the corner edge 62. In the most preferred embodiment, the first set of perforations 66 and the second set of perforations 68 are positioned at a spaced distance of about 1 inch from the corner edge 62.

It has been found that when the perforations are positioned at the above described range of spaced distances, especially in the preferred range of spaced distances, the removable strip 70 is dimensioned large enough to facilitate the grasping of the removable strip 70 by the user so that the removable strip 70 can be torn downwardly toward the bottom portion 52 to allow folding of the side panel 58 and the end panel 60 as discussed previously. Moreover, it has been found that when the perforations are positioned at the described range of preferred spaced distances, namely between about ⅞ to 2 inches from the corner edge 62, the assembly of the container 50 is facilitated. In particular, as noted previously, because the containers of the type described herein are frequently manufactured from a flat container blank (not shown), the side panel 58 and the end panel 60 are often made from a single panel which is folded along a vertically extending crease (not shown) to form the corner edge 62. If the first set of perforations 66 and/or the second set of perforations 68 are formed on the container blank at a spaced distance from the corner edge 62 but too close to the corner edge 62, the proper folding of the container blank along the vertical crease and correspondingly, the proper positioning of the corner edge 62 will be difficult to attain because the corner edge 62 will have a tendency to form where the flat container blank is weakest. Thus, the corner edge 62 may be improperly formed along either the first set of perforations 66 and the second set of perforations 68 instead of being properly positioned between the perforations. By providing perforations that are positioned at the described range of about ⅞ to 2 inches from the desired corner edge 62, such improper assembly can be avoided since there is sufficient space for assemblers or assembly automation to grasp or otherwise control the folding of the container blank so as to ensure proper positioning of the corner edge 62.

As can also be appreciated by examination of FIG. 6, the first set of perforations 66 and the second set of perforations 68 are provided on each of the corners 62, i.e. the four corners of the container 50 in the present illustrated embodiment. Consequently, in the illustrated embodiment, both the first set of perforations 66 and the second set of perforations 68 are a plurality of sets of perforations that extend substantially parallel to the four corner edges 62 to allow unconnecting of the two side panels 58 and the two end panels 60 that form each of the four corner edges 62. It should be appreciated, however, the present invention is not limited thereto and in other embodiments, the invention may be applied to containers having a different number of panels and corner edges such as triangular or hexagonal containers as well as others.

In addition, in accordance with the embodiments of the present invention, one or more of the fold facilitating creases 64 of the container 50 preferably also includes identifiable markings 72 as well. In the embodiment shown, the identifiable markings 72 are in the form of "x" and "0" that are printed on the fold facilitating creases 64. It should be noted that the identifiable markings 72 are optionally provided and may take on other forms as well, for example a color code or other symbols as well such as "+" etc. As shown, different identifiable markings may be provided on each of the plurality of fold facilitating creases 64. These identifiable markings 72, if provided, facilitate proper assembly of a container 50 having a desired volume. In particular, identifiable markings "x" identify the fold facilitating crease 64 on the two side panels 58 and the two end panels 60 which are at a same height distance from the bottom portion 52 so that the panels can be inwardly folded to provide a container 50 having a minimum volume. Likewise, the identifiable markings "0" identify the fold facilitating crease 64 on the two side panels 58 and the two end panels 60 which are at a same height distance from the bottom portion 52 as well so that the panels can be inwardly folded to provide a container 50 having an intermediate volume. Furthermore, by contrasting the fold facilitating crease which is to be folded from the other creases, the user can be careful not to tear the removable strip 70 beyond the desired fold facilitating crease thereby ensuring the structural integrity of the assembled container 50.

Figure 7A:
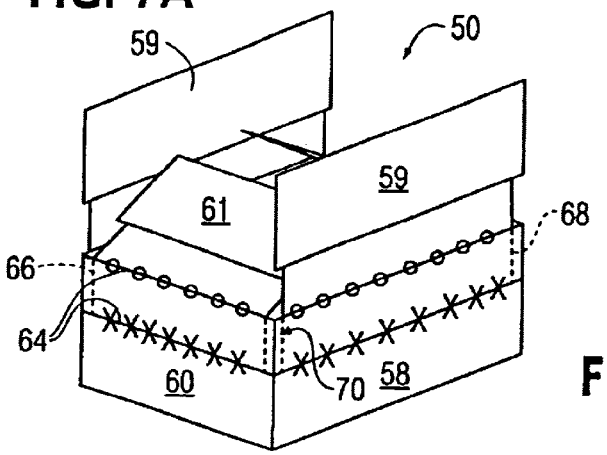
FIGS. 7A and 7B each show a perspective view of the variable volume container of FIG. 6 being folded into an intermediate volume configuration.
Figure 7B:
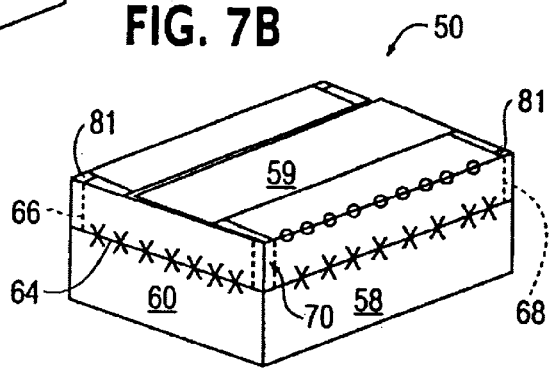
Figure 8A:
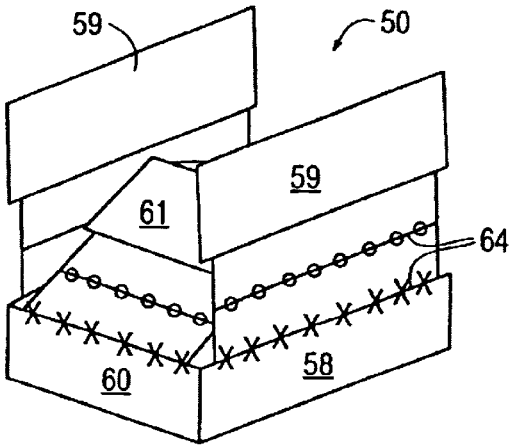
FIGS. 8A and 8B each show a perspective view of the variable volume container of FIG. 6 being folded into an minimum volume configuration.
Figure 8B:
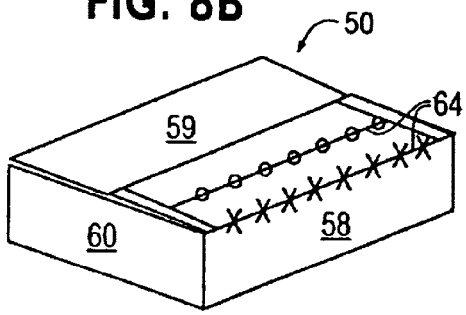

FIGS. 7A and 7B show a perspective view of the variable volume container 50 of FIG. 6 being folded into an intermediate volume configuration. As can be seen in FIG. 7A, the removable strip 70 has been removed up to the fold facilitating crease 64 marked by "0" and both the side panels 58 and the end panels 60 are inwardly folded along the fold facilitating crease 64 marked by "0" to thereby form a container having an intermediate volume shown in FIG. 7B. In a similar manner, FIGS. 8A and 8B show a perspective view of the variable volume container 50 of FIG. 6 being folded into an minimum volume configuration. In particular, FIG. 8A shows that the removable strip 70 has been removed up to the fold facilitating crease 64 marked by "x" and that both the side panels 58 and the end panels 60 are inwardly folded along the fold facilitating crease 64 marked by "x" to thereby form a container having the minimum volume shown in FIG. 8B.

Figure 9:
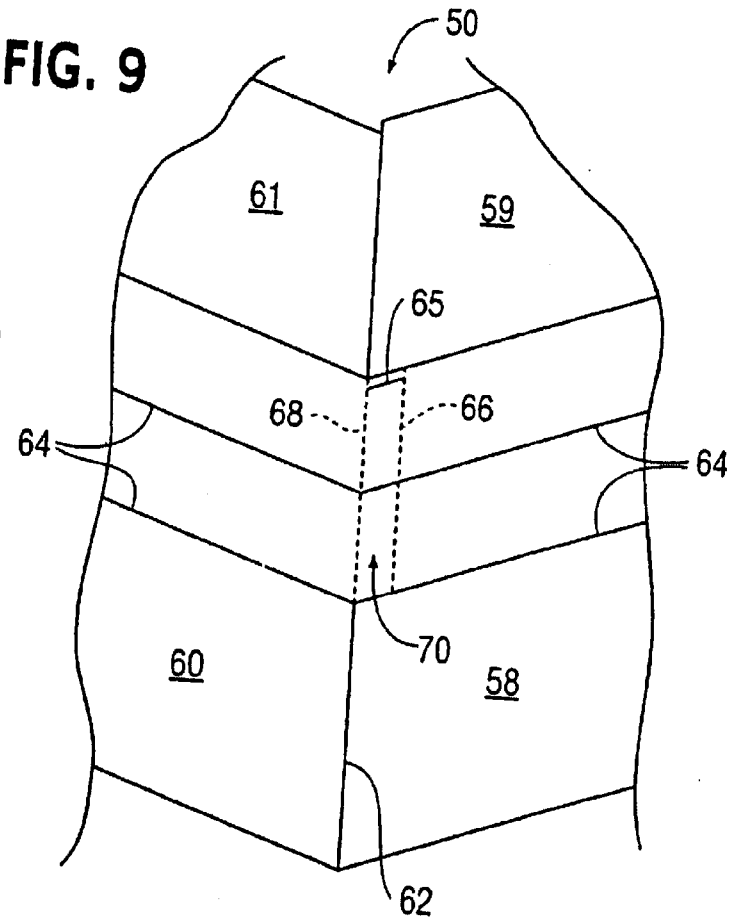
FIG. 9 shows an enlarged view of one corner of another embodiment of the variable volume container where the second set of fold facilitating creases is provided on a corner edge.

FIG. 9 shows an enlarged view of one corner of a variable volume container 50 in accordance with another embodiment of the present invention, the common elements being enumerated with the same numerals as FIGS. 6 to 8B. In this embodiment of the present invention, the second set of perforations 68 is not provided on the end panel 60, but instead, is provided directly on the corner edge 62 itself. As can be seen, the first set of perforations 66 is still provided on the side panel 58 and is positioned at a spaced distance from the second set of perforations 68 to define a removable strip 70 so that a user can grasp the removable strip 70 and remove at least a part thereof. Preferably, the first set of perforations 66 and the second set of perforations 68 are positioned at a spaced distance between about ⅛ to 2 inches, but more preferably, are positioned at a spaced distance between about ⅞ to 2 inches from each other to allow grasping of the removable strip 70 and to facilitate the manufacture and assembly of the container 50 in the manner previously discussed. In this regard, a slit 65 is provided between the sets of perforations 66 and 68 where the side panel flap 59 attaches to the side panel 58 to thereby facilitate grasping of the removable strip 70. In the same manner discussed relative to the embodiment of FIG. 6, by removing at least a portion of the removable strip 70 along the perforations 66 and 68 up to the fold facilitating crease 64, the side panel 58 and the end panel 60 can be separated and folded along the fold facilitating crease 64 to provide a container 50 having the desired volume.

Figure 10B:
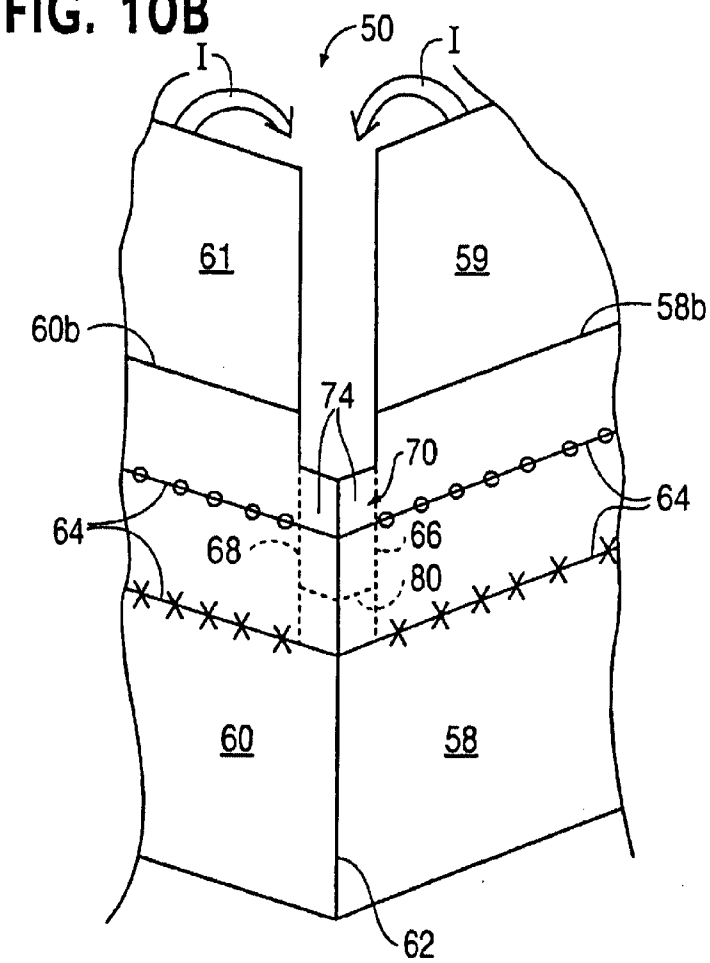
FIG. 10B shows the variable volume container of FIG. 10A with the top edge tab and a portion of the removable strip removed for folding into an intermediate volume configuration.
Figure 10A:
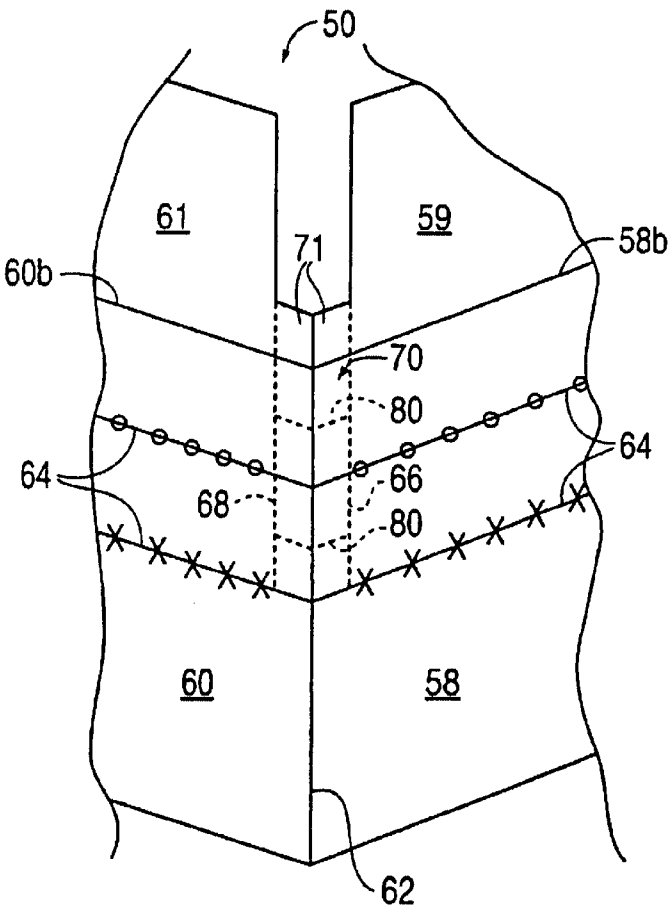
FIG. 10A shows an enlarged view of one corner of yet another embodiment of the variable volume container in accordance with the present invention including a plurality of lateral perforations.

FIG. 10A shows an enlarged view of one corner of a variable volume container 50 in accordance with another embodiment of the present invention which is similar to the container of FIG. 6, the common elements being enumerated with the same numerals. Like the embodiment of FIG. 6, the first set of perforations 66 is provided on the side panel 58 and the second set of perforations 68 are provided on the end panel 60, the first set of perforations 66 being positioned at a spaced distance from the second set of perforations 68 to define a removable strip 70 which may be grasped and at least partially removed to allow the side panel 58 and the end panel 60 to be separated and folded along the fold facilitating crease 64. The first set of perforations 66 and the second set of perforations 68 are positioned at a spaced distance between about ⅛ to 2 inches and more preferably, between about ⅞ to 2 inches from one another.

The variable volume container 50 of the embodiment shown in FIG. 10A further includes lateral perforations 80 that extend laterally between the first set of perforations 66 and the second set of perforations 68. Of course, in the embodiment shown, these lateral perforations also intersect the corner edge 62 as well since the first set of perforations 66 and the second set of perforations 68 straddle the corner edge 62. As can be clearly seen, one of the lateral perforations 80 is positioned at a height distance between the two fold facilitating creases 64 while the other lateral perforations 80 is positioned between a fold facilitating crease 64 and the top edges 58*b* and 60*b* of the two side panels 58 and the two end panels 60 respectively. Such positioning of the lateral perforations 80 allows detachment of at least a portion of the removable strip 70 so that a tab is created upon folding of the side panel 58 and the end panel 60 along the desired fold facilitating crease 64 as described further below. In addition, in other embodiments, the lateral perforations 80 may also be provided at a height distance to laterally align with the fold facilitating creases 64 to thereby allow detachment of at least a portion of the removable strip 70 without providing a tab if desired.

As also clearly shown, FIG. 10A also illustrates an embodiment of the present invention where the side panel flap 59 does not extend the full length of the top edge 58b of the side panel 58, and the end panel flap 61 does not extend the full length of the top edge 60*b* of the end panel 60. It should be appreciated by a person skilled in the art that when such side panel flap 59 and end panel flap 61 are inwardly folded to close the opening of the container 50 formed by the side panels 58 and the end panels 60, a small portion of the opening remains uncovered since the panel flaps 59, 61 do not extend the full length of the top edges 58b, 60b. Such small portion of the opening can be seen most clearly in the embodiment shown in FIG. 7B and is enumerated 81.

To eliminate such an opening 81, the present embodiment of the variable volume container includes top edge tabs 71 which are attached to the top edge 58*b* of the side panel 58 and the top edge 60*b* of the end panel 60 in the position proximate to the corner edge 62 in the manner shown. These top edge tabs. 71 are folded inwardly together with the side panel flaps 59 and the end panel flaps 61 to thereby overlap and cover the portion of the opening of the variable, volume container 50 which would otherwise remain uncovered. In addition, these top edge tabs 71 can be grasped by the user easily so that it, together with a portion of the removable strip 70, can be easily removed.

Moreover, as previously noted, the lateral perforations 80 of the illustrated embodiment of the variable volume container 50 allows detachment of a portion of the removable strip 70 so that a tab is created upon folding of the side panel 58 and the end panel 60 along the desired fold facilitating crease 64. The creation of such tabs 74 is more clearly illustrated in FIG. 10B which shows the variable volume container 50 of FIG. 10A in which a portion of the removable strip 70 (together with the top edge tabs 71) has been removed. When the side panel 58 and the end panel 60 are inwardly folded in the direction of arrows I along the fold facilitating crease 64 marked with "0" to thereby cover the opening of the variable volume container 50 having an intermediate volume in the manner discussed relative to FIGS. 7A–8B, the tabs 74 function much like the top edge tabs 72 to cover the portion of the opening of the container 50 which would otherwise remain uncovered. Thus, the lateral perforations 80 of the illustrated embodiment serve a dual function of facilitating the removal of a portion of the removable strip 70 and also providing tabs 74 which can be used to cover the portion of the opening of the container 50 that would otherwise remain uncovered.

Figure 11:
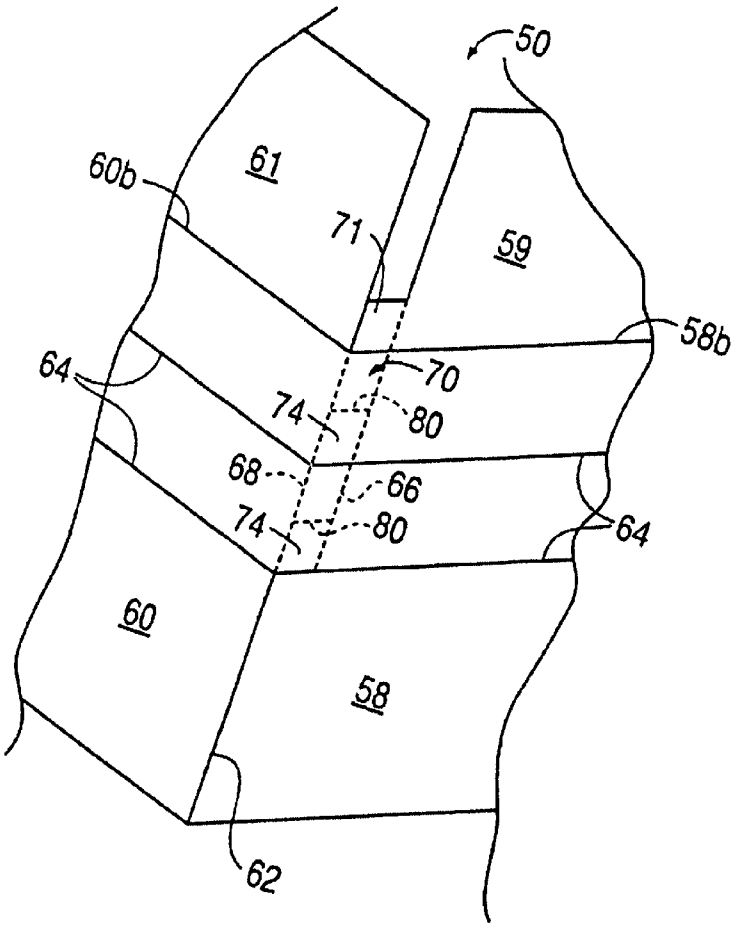
FIG. 11 shows an enlarged view of one corner of still another embodiment of the variable volume container in accordance with the present invention including a plurality of lateral perforations.

FIG. 11 shows a view of one corner of still another embodiment of the variable volume container 50 which is similar to the container of FIG. 9, the common elements being enumerated with the same numerals. As can be seen, like the embodiment of FIG. 9, the second set of perforations 68 is provided directly on the corner edge 62 of the variable volume container 50 at a spaced distance from the first set of perforations 66 provided on the side panel 58 to thereby define a removable strip 70. In this regard, the first set of perforations 66 and the second set of perforations 68 are positioned at a spaced distance between about ⅛ to 2 inches, but more preferably, are positioned at a spaced distance between about ⅞ to 2 inches from each other. As can also be seen, the side panel flap 59 does not extend the full length of the top edge 58*b* of the side panel 58. However, a top edge tab 71 which is attached to the top edge 58*b* of the side panel 58 is provided so that it can be folded inwardly together with the side panel flaps 59 and the end panel flaps 61 to thereby provide a continuous coverage of the opening of the variable volume container. 50 along the top edge 58*b*. In addition, as previously noted, these top edge tabs 72 can be easily grasped by the user so that they, together with a portion of the removable strips 70, can be easily removed. Moreover, like the previous embodiment discussed, the lateral perforations 80 allows detachment of a portion of the removable strip 70 so that a tab 74 is created upon folding of the side panel 58 and the end panel 60 along the desired fold facilitating crease 64 to thereby allow continuous coverage of the opening of the variable volume container 50.

Figure 12:
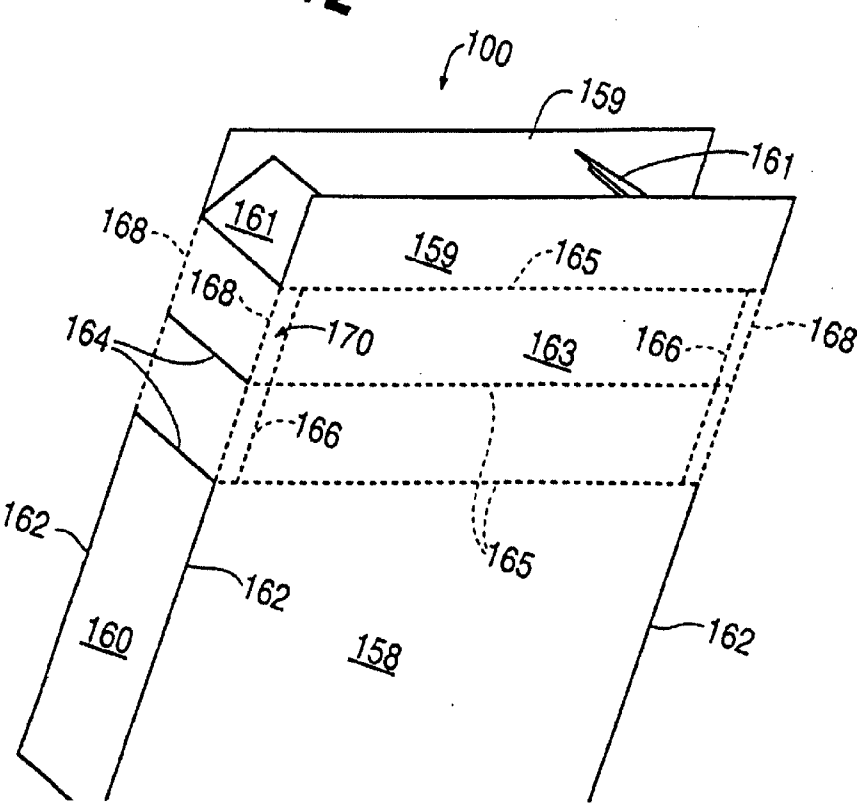
FIG. 12 shows a perspective view of yet another embodiment of the variable volume container in accordance with the present invention where the side panel also includes perforations for removing a portion of the side panel to change the volume of the container.

FIG. 12 shows a perspective view of yet another embodiment of a variable volume container 100 in accordance with the present invention having an elongated shape similar to the containers provided by Federal Express®, the U.S. Postal Service, and other 20 shipping companies. The variable volume container 100 includes a bottom portion 152, two side panels 158 (only one shown) and two end panels 160 (only one shown) that extend upwardly from the bottom portion 152 to define the variable volume container 100. Each of the two side panels 158 have edges which are attached to edges of each of the two end panels 160 to thereby form four corner edges 162 of the container 100. In the illustrated embodiment, the container 100 also includes two side panel flaps 159 and two end panel flaps 161 that are attached to the two side panels 158 and the two end panels 160 respectively that may be used to cover the opening of the container 100 in a known conventional manner to provide a configuration with maximum volume. In addition, similar to the previously discussed embodiments, a plurality of fold facilitating creases 164 are provided to allow the container 100 to be configured to have various volumes. In this regard, a plurality of fold facilitating creases 164 are provided, one of the fold facilitating creases 164 being positioned at a greater height distance from the bottom portion 152 (i.e. upper fold facilitating crease) than the other fold facilitating crease 164 (i.e. lower fold facilitating crease) to allow two end panels 160 and one of the side panels 158 to be inwardly folded to provide a container having the desired volume. In this regard, as can be seen, a first set of perforations 166 is provided on the side panel 158 while the second set of perforations 168 is provided on a corner edge 162 at a spaced distance from the first set of perforations 166 to define a removable strip 170. Again, the first set of perforations 166 and the second set of perforations 168 is positioned at a spaced distance between about ⅛ to 2 inches, but more preferably, is positioned at a spaced distance between about ⅞ to 2 inches from each other.

Figure 13A:
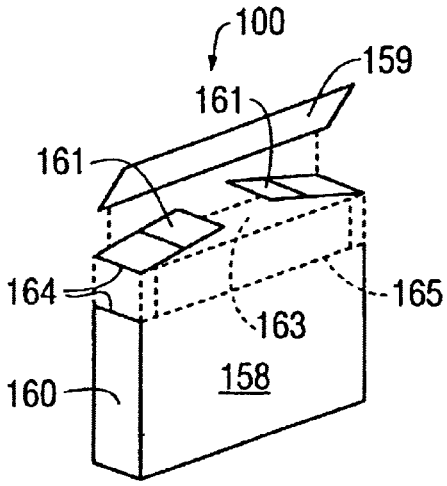
FIGS. 13A and 13B each show a perspective view of the variable volume container of FIG. 12 being folded into an intermediate volume configuration.
Figure 13B:
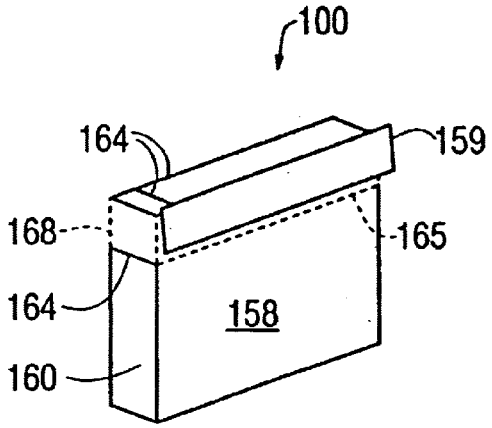
Figure 14A:
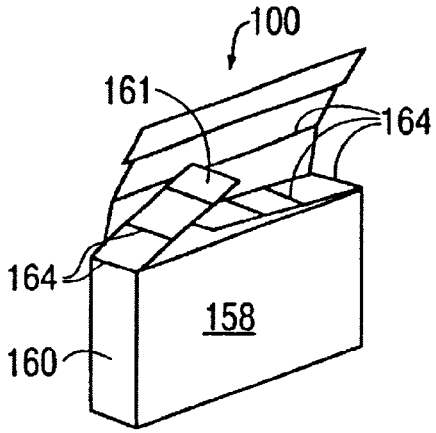
FIGS. 14A and 14B each show a perspective view of the variable volume container of FIG. 12 being folded into a minimum volume configuration.
Figure 14B:
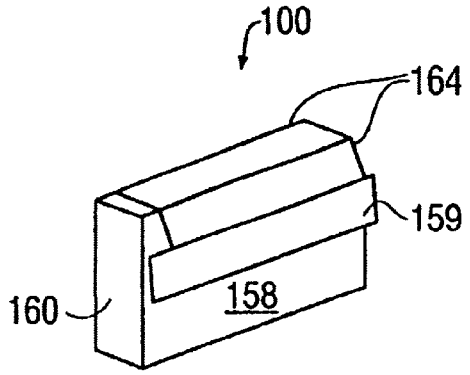

However, in contrast to the previous embodiments, at least one of the side panels 158 (shown) includes perforations 165 for allowing the removal of the side panel flap 159 and for providing a removable portion 163 on the side panel 158. The removal of the side panel flap 159 with, or independently from, the removable portion 163 allows change in the volume of the variable volume container 100 in the manner described in further detail below. FIGS. 13A and 13B show a perspective view of the variable volume container 100 of FIG. 12 being folded into an intermediate volume configuration. As can be seen in FIG. 13A, the removable strip 170 is partially removed and the side panel flap 159 on one of the side panels 158 has been removed. The removable portion 163 is inwardly folded along the middle perforation 165 to cover the opening of the container 100 so that the removable portion 163 serves as the side panel flap 159 (which has been removed) and both of the end panels 160 are inwardly folded along the upper fold facilitating crease 164. In addition, as can be seen and appreciated by one skilled in the art, the other side panel flap 159 is brought over the opening of the container 100 in the manner shown in FIG. 13B to thereby form a container having an intermediate volume. In a similar manner, FIGS. 14A and 14B each show a perspective view of the variable volume container 100 of FIG. 12 being folded into a minimum volume configuration. In particular, FIG. 14A shows the removable strip 170 is fully removed and the side panel flap 159 as well as the removable portion 163 on one of the side panels 158 has been removed. The side panel 158 is inwardly folded along the lower perforation 165 to cover the opening of the container 100 so that the section below the removable portion 163 serves as the side panel flap 159 (which has been removed) and both of the end panels 160 are inwardly folded along the lower fold facilitating crease 164. In addition, as can be seen and appreciated by one skilled in the art, the other side panel flap 159 is brought over the opening of the container 100 in the manner shown in FIG. 14B to thereby form a container having a minimum volume. It should be appreciated that while in the above discussed embodiments, an embodiment is shown where the second set of perforations 168 is provided directly on the corner edge 162, it may also be provided on the end panels 160 in other embodiments. Additionally, other embodiments can also have the removable strips 170 on the end panels 160 instead of the side panels 158 and the removable portion 163 and the section below it can be completely removed instead of being inwardly folded. Moreover, this embodiment of the present invention may also be provided with lateral perforations in the manner discussed previously relative to FIGS. 10A to 11 and also be provided with slits/slots 65 as shown in FIGS. 6 and 9 and also in FIG. 15 as discussed below.

Figure 15:
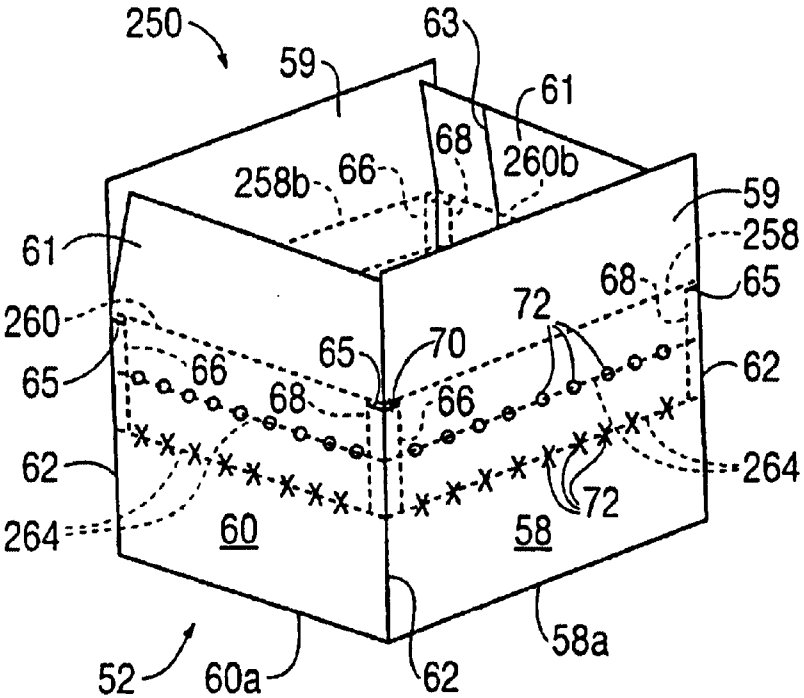
FIG. 15 shows a perspective view of the variable volume container where the plurality of fold facilitating creases are formed by fold facilitating perforations.

FIG. 15 shows yet another embodiment of a variable volume container 250 in accordance with the present invention which is substantially similar to the embodiment shown in FIG. 6. However, as noted previously and clearly evident by examination of FIG. 15, the plurality of fold facilitating creases in this embodiment is formed by a plurality of fold facilitating perforations 264. In addition, even the side panel flaps 59 and the end panel flaps 61 are attached to the side panels 58 and the end panels 60 respectively at their top edges which is also provided with perforations 258 and 260. This allows the user to easily remove these panel flaps 59 and 61 as well as portions of the side panels 58 and the end panels 60 as needed based on the application and use of the container 250.

Figure 16B:
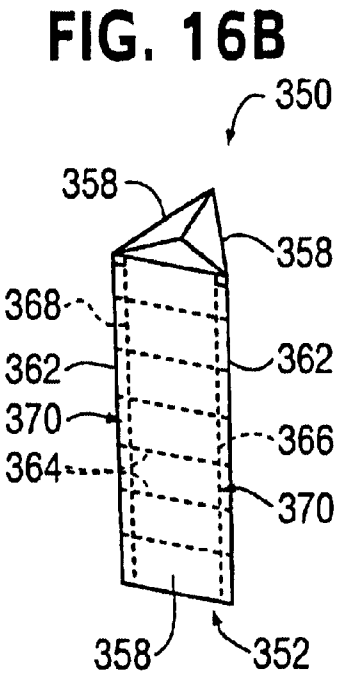
FIG. 16B shows a perspective view of the variable volume container of FIG. 16A which has been reduced in volume.
Figure 16A:
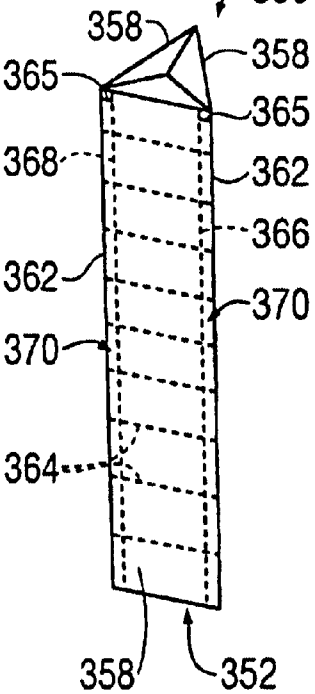
FIG. 16A shows a perspective view of yet another embodiment of the variable volume container in accordance with the present invention having a triangular shape where the side panel also includes perforations for removing a portion of the side panel to change the volume of the container.

FIGS. 16A and 16B each show a perspective view of yet another embodiment of a variable volume container 350 in accordance with the present invention having a triangular shape. As can be appreciated, the bottom portion 352 is triangularly shaped so that the container 350 is triangular. The panels 358 that extend upwardly from the bottom portion 352 are joined at the edges to one another to thereby provide corner edges 362. As can also be seen, the panels 358 include a first set of perforations 366 and a second set of perforations 368 which straddle the corner edges 362 of the container and are positioned at a spaced distance between about ⅛ to 2 inches from the corner edge 362 to thereby form removable strips 370. Preferably, the first set of perforations 366 and the second set of perforations 368 are positioned at a spaced distance between about ⅞ to 2 inches from the corner edge 362. In the most preferred embodiment, the first set of perforations 366 and the second set of perforations 368 are positioned at a spaced distance of about 1 inch from the corner edge 362. However, it should also be recognized that like the previously discussed rectangular containers, the second set of perforations 368 may be provided directly on the corner edges 362. The panels 358 further include fold facilitating creases which are formed as perforations 364 to thereby allow removal of sections of the panels 358 so that the volume of the container can be changed.

FIG. 16B shows a perspective view of the variable volume container 350 which has been reduced in volume. This configuration of the variable volume container 350 is attained in a manner similar to the previously discussed embodiments. Thus, the first set of perforations 366 and the second set of perforations 368 are used to detach the panels 358 from one another so that desired sections of the panels 358 can be removed and the volume of the container can be easily changed. In this regard, the variable volume container 350 may also include slits 365 to facilitate grasping of the strip 370. Of course, as previously noted, whereas in the above discussed embodiments, the variable volume containers have a rectangular or a triangular shape, the present invention may be applied to other container configurations as well, such as hexagonal containers. However, the applicant has found that the present invention is especially applicable to rectangular boxes.

It should be noted that in the above discussed embodiments of the present invention, the means for separating the panels of the container have been a removable strip formed by perforations provided on the panels. However, in other embodiments, any one or more of the perforations may instead, be substituted with other separating means such as pullable, reinforcements (not shown) similar to those in Federal Express® ( boxes and U.S. Postal Service priority boxes which are used for facilitating opening sealed shipping boxes. These pullable reinforcements may be used instead of the above described perforations to separate the desired portions of the container in accordance with the present invention. Such pullable reinforcements are generally not made of paperboard but instead, are made of a polymer, plastic or other appropriate material. For instance, in one such embodiment, instead of providing the first and second sets of perforations to thereby define a removable strip as in the previous embodiments, the pullable reinforcements would be embedded and/or attached to the panels, preferably in the interior of the container, in the locations proximate to the corners formed by the panels. By pulling on pullable reinforcements, a removable strip is formed by tearing of the panels at or along the edges of the pullable reinforcements. Thus, the pullable reinforcement would serve a similar function as the perforations in that it provides the desired removable strip and the panels can then be separated. The pullable reinforcement need not be continuous but instead, can be a plurality of reinforcement segments that terminate at each of the plurality of lateral perforations or fold facilitating creases if such plurality of perforations or creases are provided. The pullable reinforcement may also include a reinforcement filament embedded therein to provide further strength to the pullable reinforcement. Of course, such a pullable reinforcement may also be provided laterally as well so as to replace the lateral perforations also described previously.

Figure 17:
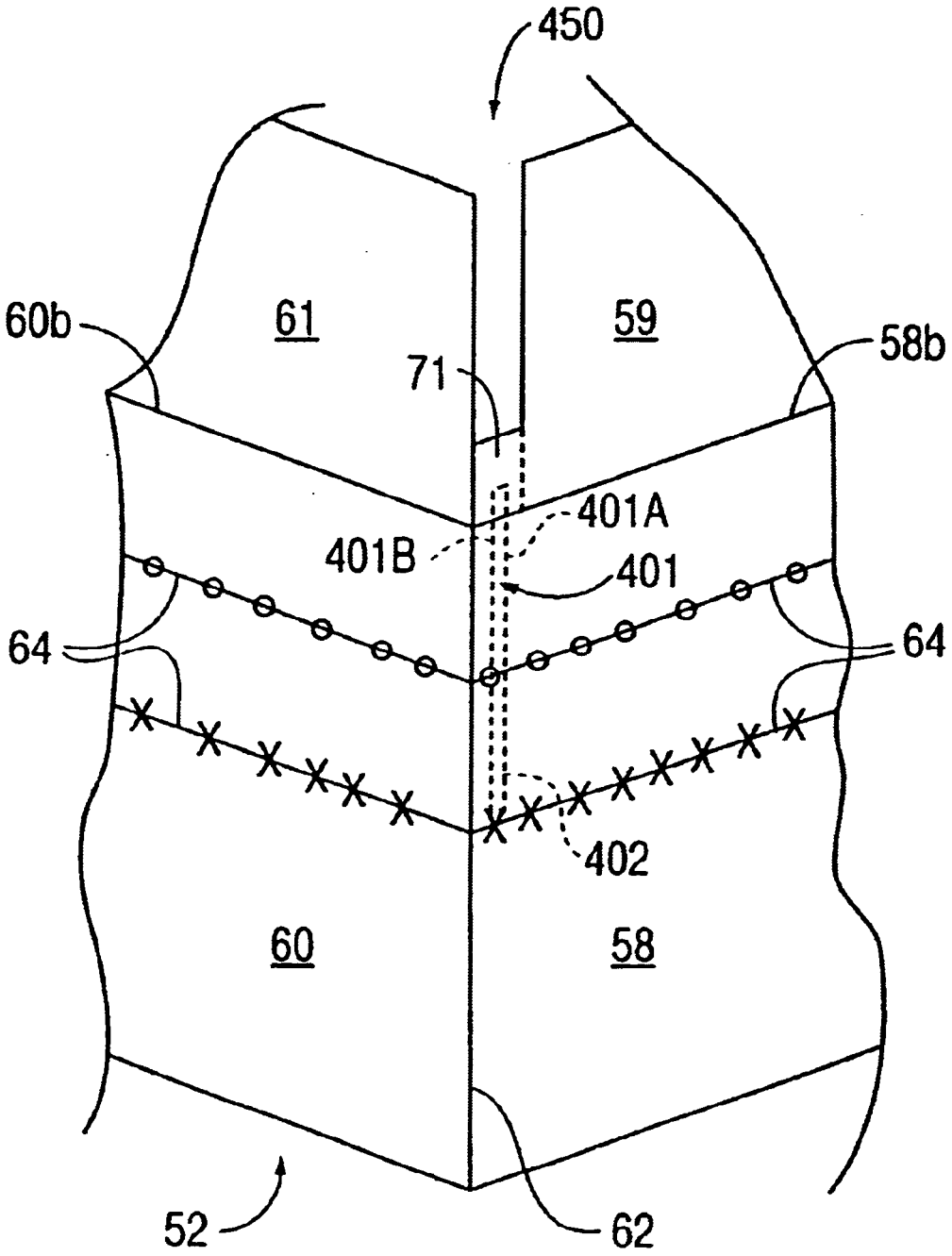
FIG. 17 shows an enlarged view of one corner of yet another embodiment of the variable volume container in accordance with the present invention including a pullable reinforcement.

FIG. 17 shows an enlarged view of one corner of such an embodiment of the variable volume container 450 in accordance with the present invention, the common elements being enumerated with the same numerals as FIGS. 6 to 11. As can be seen, the side panel flap 59 does not extend the full length of the top edge 58*b* but instead, the container 450 is provided with a top edge tab 71 which can be folded inwardly together with the side panel flaps 59 and the end panel flaps 61 to thereby provide a continuous coverage of the opening of the variable volume container 450 along the top edge 58*b*. As previously described, these top edge tabs 71 can be easily grasped by the user so that they can be easily pulled. However, in contrast with the previously illustrated embodiments, the container 450 is not provided with the first and second set of perforations which define a removable strip, but instead is provided with a pullable reinforcements 401, 402 which are attached to the interior of the side panels 58. It should be clarified that in FIG. 17, the pullable reinforcements 401, 402 are shown as dashed lines because they are attached to the interior of the side panels 58 and do not represent perforations. As can also be seen, the pullable reinforcements 401, 402 are in the locations proximate to the corners 62 formed by the side panels 58 and the end panels 60. The pullable reinforcement 401 preferably extends to the top edge tab 71 so that by pulling on the top edge tab 71, the pullable reinforcement 401 is also pulled with it. In addition, the pullable reinforcement 401 terminates at the foldable crease 64 indicated by "0", another pullable reinforcement 402 extending between the foldable creases 64 indicated by "0" and "x". When the top edge tab 71 is downwardly pulled toward the bottom portion 52, the edges 401A and 401B of the pullable reinforcement 401 tears through the side panel 58 thereby separating the side panel 58 from the end panel 60 and forming a removable strip (not shown) which includes a torn portion of the side panel 58 and the pullable reinforcement 401. Because the pullable reinforcement 401 terminates at the foldable crease 64 indicated by "0", the removable strip can be removed along the foldable crease 64 to thereby provide a variable volume container 450 having an intermediate volume when the side panels 58 and the end panels 60 are folded along the foldable crease 64 indicated by "0".

To provide a variable volume container 450 having a minimum volume, the pullable reinforcement 402 is similarly pulled so that its edges tear through the side panel 58 to thereby further separate the side panel 58 from the end panel 60. Because the pullable reinforcement 401 terminates at the foldable crease 64 indicated by "x", the removable strip formed by the pullable reinforcement 402 can be removed to correspondingly provide a variable volume container 450 having a minimum volume when the side panels 58 and the end panels 60 are folded along the foldable crease 64 indicated by "x".

Thus, in the above described manner, the pullable reinforcement serve a similar function as the perforations discussed in the previous embodiments in that the pullable reinforcement provides the desired removable strip so that the panels of the container can be separated. It should also be appreciated that while in the presently described embodiment, the pullable reinforcement are made as plurality of reinforcement segments, in other embodiments, the pullable reinforcement may also be continuous. The pullable reinforcement may also include a reinforcement filament embedded therein to provide further strength to the pullable reinforcement. Moreover, the pullable reinforcement as described above may also be provided laterally to replace the lateral perforations previously described in other embodiments as well. In this regard, it should be appreciated that FIG. 17 illustrates only one embodiment wherein such pullable reinforcement is used and the various other embodiments of the variable volume container as shown in FIGS. 1 to 16B can also be provided with such pullable reinforcement in lieu of or in addition to the various perforations described.

A variable volume container having such a pullable reinforcement as the separating means would have increased strength than a comparable container having perforations and thus, is more desirable in applications where the variable volume container is used to contain heavy objects/contents. However, it should also be noted that the use of perforations is preferred in other applications since the removal of the desired portions of the selectable volume container can be performed more neatly than would be possible with such pullable reinforcements. Moreover, the use of perforations would also be easier to manufacture thereby making the container with perforations more economical than a container with such pullable reinforcements.

It is thought that the present CONTAINER HAVING A PLURALITY OF SELECTABLE VOLUMES, for use in the package shipping and mailing industry, and many of its attendant advantages is understood from the foregoing description and it will be apparent that various changes may be made in the form, construction and arrangement of the parts thereof without departing from the spirit and scope of the invention or sacrificing any of its material advantages, the forms herein before described being not limiting but merely preferred or exemplary embodiments.

I claim:

1. A container having a plurality of selectable volumes so that volume of said container may be selected when said container is assembled and functional to hold contents therein, said container comprising:

a bottom portion formed by a plurality of bottom flaps, each bottom flap having plurality of free edge;

a plurality of panels attached to and extending upwardly from said bottom portion, each of said plurality of panels having edges which are attached to edges of each other to thereby form a plurality of corner edges of said container;

at least one fold facilitating crease laterally extending across said plurality of panels, said at least one fold facilitating crease being positioned between said bottom portion and tops of said plurality of panels so as to allow said plurality of panels to be folded along said at least one fold facilitating crease to select volume of said container where said container is assembled; and a first set and a second set of perforations, said first set of perforations vertically extending substantially parallel to at least one corner edge and terminating prior to said plurality of free edges on said corresponding bottom flap, and said second set of perforations vertically extending substantially parallel to said first set of perforations, said first set and said second set of perforations thereby defining a removable strip for unconnecting from one another two panels that form said at least one corner edge to facilitate selection of the volume of said container by unconnecting said two panels and folding said two panels along said at least one fold facilitating crease to thereby reduce volume of said container when said container is assembled;

wherein said first set of perforations and said second set of perforations are positioned at a spaced distance from each other, said spaced distance being sufficient to allow a user to grasp said strip for removal of at least a part thereof; and wherein said first set of perforations is provided on a first panel, and said second set of perforations is provided on at least one of said at least one corner edge and a second panel that together with said first panel, forms said at least one corner edge, said first set of perforations being positioned on said first panel at a spaced distance between about ⅛ to 2 inches from said at least one corner edge, and said second set of perforations being positioned at a spaced distance up to about 2 inches from said at least one corner edge.

2. The container having a plurality of selectable volumes of claim 1, wherein said at least one fold facilitating crease includes an identifiable marking to facilitate identification of said at least one fold facilitating crease on said plurality of panels.

3. The container having a plurality of selectable volumes of claim 1, wherein said first set of perforations is a plurality of first set of perforations and said second set of perforations is a plurality of second set of perforations, said plurality of first set of perforations and said plurality of second set of perforations extending substantially parallel to each of said plurality of corner edges to allow unconnecting of said plurality of panels that form said plurality of corner edges.

4. The container having a plurality of selectable volumes of claim 1, further including panel flaps attached along a top edge of each of said plurality of panels and at least one of a slit and a slot provided along said top edge between said first set and said second set of perforations to thereby facilitate grasping of said removable strip.

5. The container having a plurality of selectable volumes of claim 1, wherein said second set of perforations is positioned at a spaced distance between about ⅛ to 2 inches from said at least one corner edge.

6. The container having a plurality of selectable volumes of claim 1, wherein said second set of perforations is positioned on said at least one corner edge.

7. The container having a plurality of selectable volumes of claim 1, wherein said removable strip is reinforced with a reinforcement backing to facilitate removal of said removable strip.

8. The container having a plurality of selectable volumes of claim 1, wherein said at least one fold facilitating crease is formed by a fold facilitating perforation.

9. The container having a plurality of selectable volumes of claim 8, wherein said fold facilitating perforation is adapted to allow removal of at least a portion of at least one of said plurality of panels.

10. The container having a plurality of selectable volumes of claim 1, wherein said bottom portion has a polygonal shape.

11. The container having a plurality of selectable volumes of claim 10, wherein said bottom portion has a rectangular shape so that said container is rectangular.

12. The container having a plurality of selectable volumes of claim 10, wherein said bottom portion has a triangular shape so that said container is triangular.

13. The container having a plurality of selectable volumes of claim 1, further including at least one lateral perforation extending laterally between said first set of perforations and said second set of perforations to allow detachment of at least a portion of said removable strip.

14. The container having a plurality of selectable volumes of claim 13, wherein said at least one lateral perforation is positioned at a height distance larger than said at least one fold facilitating crease so that a tab is provided upon folding of said plurality of panels along said at least one of said fold facilitating creases.

15. The container having a plurality of selectable volumes of claim 14, further including panel flaps attached along a top edge of each of said plurality of panels, wherein said tab is adapted to be inwardly folded together with said panel flaps to cover an opening of said container.

16. The container having a plurality of selectable volumes of claim 1, further including panel flaps and tabs that are attached along a top edge of at least one of said plurality of panels, wherein said tabs are adapted to be inwardly folded together with said panel flaps to cover an opening of said container.

17. A container having a plurality of selectable volumes so that volume of said container may be selected when said container is assembled and functional to hold contents therein, said container comprising:

a bottom portion having a substantially rectangular shape, formed by a plurality of bottom flaps, each bottom flap having free edges, said bottom portion having two substantially parallel side edges and two substantially parallel end edges;

two side panels attached to and extending upwardly from said two side edges of said bottom portion;

two end panels attached to and extending upwardly from said two end edges of said bottom portion, each of said two end panels having edges which are attached to edges of each of said two side panels to thereby form four corner edges of said container;

a plurality of fold facilitating creases laterally extending across said two side panels and said two end panels, said plurality of fold facilitating creases being positioned between said bottom portion and tops of said two side panels and said two end panels so as to allow said two side panels and said two end panels to be folded along at least one of said plurality of fold facilitating creases to select volume of said container when said container is assembled; and a first set and a second set of perforations said first set of perforations, vertically extending substantially parallel to a corner edge and terminating before reaching one of said free edges on said corresponding bottom flap, and said second set of perforations vertically extending substantially parallel to said first set of perforations, said first set and said second set of perforations thereby allowing unconnecting of a side panel and an end panel that form said corner edge to facilitate selection of the volume of said container by unconnecting said two panels and folding said two panels along at least one of said plurality of fold facilitating crease to thereby reduce volume of said container when said container is assembled;

wherein said first set of perforations is provided on one of said side panel and said end panel that form said corner edge, said first set of perforations being positioned at a spaced distance between about ⅛ to 2 inches from said corner edge, and said second set of perforations is provided on at least one of said corner edge and the other of said side panel and said end panel that form said corner edge, said second set of perforations being positioned at a spaced distance up to about 2 inches from said corner edge;

wherein said first set of perforations is a plurality of first set of perforations and said second set of perforations is a plurality of second set of perforations, said plurality of first set of perforations and said plurality of second set of perforations extending substantially parallel to said four corner edges to allow unconnecting of said two side panels and said two end panels that form each of said four corner edges;

wherein each of said plurality of first set of perforations is provided on one of said side panel and said end panel and is positioned at a spaced distance between about ⅛ to 2 inches from at least one corner edge, and each of said plurality of second set of perforations is provided on the other of said side panel and said end panel and is positioned at a spaced distance up to about 2 inches from at least one corner edge.

18. The container having a plurality of selectable volumes of claim 17, wherein said at least one fold facilitating crease includes an identifiable marking to facilitate identification of at least one fold facilitating crease on said two side panels and said two end panels.

19. The container having a plurality of selectable volumes of claim 17, wherein at least one fold facilitating crease is formed by a fold facilitating perforation.

20. The container having a plurality of selectable volumes of claim 19, wherein said fold facilitating perforation is adapted to allow removal of at least a portion of at least one of said two side panels and said two end panels.

21. The container having a plurality of selectable volumes of claim 17, further comprising a plurality of lateral perforations that extend laterally between said plurality of first set of perforations and said plurality of second set of perforations, each of said plurality of lateral perforations being positioned at a height distance between said plurality of fold facilitating creases.

22. The container having a plurality of selectable volumes of claim 17, further comprising a plurality of lateral perforations that extend laterally between said plurality of first set of perforations and said plurality of second set of perforations, each of said plurality of lateral perforations being positioned at a height distance to laterally align with said plurality of fold facilitating creases.

23. The container having a plurality of selectable volumes of claim 17, further including side panel flaps attached along a top edge of each of said two side panels and end panel flaps attached along a top edge of each of said two end panels.

24. The container having a plurality of selectable volumes of claim 23, further including at least one top edge tab attached along a top edge of at least one of said two side panels and said two end panels.

25. The container having a plurality of selectable volumes of claim 24, further including at least one of a slit and a slot provided along said top edge between said first set and said second set of perforations.

26. The container having a plurality of selectable volumes of claim 17, wherein said first set of perforations is positioned at a spaced distance between about ⅞ to 2 inches from said corner edge, and said second set of perforations is positioned at a spaced distance between about ⅞ to 2 inches from said corner edge.

27. The container having a plurality of selectable volumes of claim 26, wherein said first set of perforations is positioned at a spaced distance about 1 inch from said corner edge, and said second set of perforations is positioned at a spaced distance about 1 inch from said corner edge.

28. The container having a plurality of selectable volumes of claim 26, further including at least one lateral perforation extending laterally between said first set of perforations and said second set of perforations.

29. The container having a plurality of selectable volumes of claim 28, wherein said at least one lateral perforation is positioned at a height distance larger than at least one fold facilitating crease.

30. The container having a plurality of selectable volumes of claim 28, wherein said at least one lateral perforation is positioned at a same height distance as at least one fold facilitating crease.

31. The container having a plurality of selectable volumes of claim 17, wherein said first set of perforations is positioned at a spaced distance between about ⅞ to 2 inches from said corner edge, and said second set of perforations is positioned on said corner edge.

32. The container having a plurality of selectable volumes of claim 31, wherein said first set of perforations is positioned at a spaced distance about 1 inch from said corner edge.

33. The container having a plurality of selectable volumes of claim 31, further including at least one lateral perforation extending laterally between said first set of perforations and said second set of perforations.

34. The container having a plurality of selectable volumes of claim 33, wherein said at least one lateral perforation is positioned at a height distance larger than at least one fold facilitating crease.

35. The container having a plurality of selectable volumes of claim 33, wherein said at least one lateral perforation is positioned at a same height distance as at least one fold facilitating crease.

36. The container having a plurality of selectable volumes of claim 17, wherein each of said plurality of second set of perforations is provided on the other of said side panel and said end panel and is positioned at a spaced distance between about ⅛ to 2 inches from said at least one corner edge.

37. A container having a plurality of selectable volumes so that volume of said container may be selected when said container is assembled and functional to hold contents therein, said container comprising:

a bottom portion having a plurality of edges;

a plurality of panels attached to and extending upwardly from said plurality of edges of said bottom portion, each of said plurality of panels having edges which are attached to edges of each other to thereby form a plurality of corner edges of said container;

at least one fold facilitating crease laterally extending across said plurality of panels, said at least one fold facilitating crease being positioned between said bottom portion and tops of said plurality of panels and being adapted to allow said plurality of panels to be folded along said at least one fold facilitating crease to select volume of said container when said container is assembled thereby providing a container having a plurality of selectable volumes; and a separating means for unconnecting from one another two panels that form at least one corner edge to facilitate selection of volume of said container, said separating means extending vertically relative to said at least one fold facilitating crease and being substantially parallel to said at least one corner edge, said separating means having a width dimension sufficient to allow a user to grasp and pull said separating means to thereby unconnected said two panels that form at least one corner edge and to reduce volume of said container when said container is assembled by folding said two panels along said at least one fold facilitating crease;

wherein said separating means is a removable strip defined by a first set of perforations and a second set of perforations positioned at a spaced distance from each other and terminating above said plurality of edges of said bottom portion, said spaced distance being sufficient to allow a user to grasp said strip; and wherein said first set of perforations is provided on one of a side panel and an end panel which together define said at least one corner edge and is positioned at a spaced distance between about ⅛ to 2 inches from said at least one corner edge, and said second set of perforations is provided on the other of said side panel and said end panel and is positioned at a spaced distance up to about 2 inches from at least one corner edge.

38. The container having a plurality of selectable volumes of claim 37 further including at least one lateral separating means extending laterally between said first set and second set of separating means to allow detachment of at least a portion of said removable strip.

39. The container having a plurality of selectable volumes of claim 38, wherein said at least one lateral separating means is at least one of a perforation and a pullable reinforcement.

40. The container having a plurality of selectable volumes of claim 37, wherein said separating means further includes a pullable reinforcement.

41. The container having a plurality of selectable volumes of claim 40, wherein said pullable reinforcement is a least one of attached to and embedded on at least one said plurality of panels.

42. The container having a plurality of selectable volumes of claim 41, wherein said pullable reinforcement extends parallel to said at least one corner edge.

43. The container having a plurality of selectable volumes of claim 42, wherein said pullable reinforcement extends to and terminates at said at least one fold facilitating crease.

44. The container having a plurality of selectable volumes of claim 43, wherein said at least one fold facilitating crease is a plurality of fold facilitating creases and said pullable reinforcement is a plurality of pullable reinforcement segments, each of plurality of pullable reinforcement segments extending between said plurality of fold facilitating creases.

45. The container having a plurality of selectable volumes of claim 42, wherein said pullable reinforcement includes a reinforcing filament extending therethrough.

46. The container having a plurality of selectable volumes of claim 37, wherein said second set of perforations is positioned on said at least one corner edge.

47. The container having a plurality of selectable volumes of claim 37, wherein said second set of perforations is positioned at a spaced distance between about ⅛ to 2 inches from said at least one corner edge.

* * * * *